US010435226B2

(12) United States Patent
Phipps et al.

(10) Patent No.: US 10,435,226 B2
(45) Date of Patent: Oct. 8, 2019

(54) DOSING DISPENSER SYSTEM

(71) Applicant: DOSELOGIX, LLC, Woodstock, GA (US)

(72) Inventors: Timothy Gayle Phipps, Woodstock, GA (US); Saundra D. Naughton, White, GA (US); Craig Jay Cochran, Atlanta, GA (US); John Britton S. Mockridge, Roswell, GA (US); Daniel Lee DeYoung, Woodstock, GA (US); Dale Melton Coker, Woodstock, GA (US)

(73) Assignee: DOSELOGIX, LLC, Woodstock, GA (US)

( * ) Notice: Subject to any disclaimer, the term of this patent is extended or adjusted under 35 U.S.C. 154(b) by 0 days.

(21) Appl. No.: 15/847,167

(22) Filed: Dec. 19, 2017

(65) Prior Publication Data

US 2018/0178968 A1 Jun. 28, 2018

Related U.S. Application Data

(60) Provisional application No. 62/439,280, filed on Dec. 27, 2016.

(51) Int. Cl.
*B65D 83/00* (2006.01)
*A45D 40/00* (2006.01)

(52) U.S. Cl.
CPC ..... *B65D 83/0022* (2013.01); *A45D 40/00* (2013.01); *B65D 83/0011* (2013.01); *A45D 2200/055* (2013.01)

(58) Field of Classification Search
CPC ..... B65D 83/0022; B65D 83/0011; A45D 40/00; A61J 1/00
USPC ..... 222/326, 386, 390
See application file for complete search history.

(56) References Cited

U.S. PATENT DOCUMENTS 3,253,592 A * 5/1966 Von Pechmann ..... A61M 5/178 222/386
3,659,749 A * 5/1972 Schwartz ..... A61M 5/31596 222/129
3,967,759 A * 7/1976 Baldwin ..... A61M 5/3129 222/129
4,560,352 A * 12/1985 Neumeister ..... A61C 9/0026 222/390
5,626,566 A * 5/1997 Petersen ..... A61M 5/31551 222/309
2006/0178631 A1* 8/2006 Gillespie ..... A61M 5/001 604/139
2007/0235475 A1* 10/2007 Schneider ..... B05C 17/00576 222/325
2012/0064481 A1* 3/2012 Cannon ..... A61C 5/62 433/90
2012/0175384 A1* 7/2012 Greter ..... A61M 5/19 222/137

* cited by examiner

*Primary Examiner* — Donnell A Long
(74) *Attorney, Agent, or Firm* — Kilpatrick Townsend & Stockton LLP

(57) ABSTRACT

A dosing dispenser includes a housing, a traveler, and a plunger. The dosing dispenser also includes a driver. The housing defines a chamber, and the traveler and plunger are each positionable within the chamber. The traveler is configured to selectively position the plunger along an axis in at least one direction within the chamber.

20 Claims, 36 Drawing Sheets

DOSING DISPENSER SYSTEM

REFERENCE TO RELATED APPLICATIONS

This application claims the benefit of U.S. Provisional Application No. 62/439,280, filed Dec. 27, 2016 and entitled DOSING DISPENSER SYSTEM AND METHOD, the content of which is hereby incorporated by reference in its entirety.

FIELD OF THE INVENTION

This application relates to dispensers for flowable compositions, and more particularly to a dispenser having a base which causes a plunger to urge a predetermined amount of flowable composition through an opening in the dispenser.

BACKGROUND

Traditionally, topically administered medicine was often formulated as liquids. Applying a liquid to a skin surface often resulted in a portion of the dose spreading beyond the target area. Cream-based formulations were developed as viscous liquids to prevent the unintended application of the medicine to an unaffected area. More recently, pharmacists have been taking traditional medicines and "compounding" them in a cream base.

Administering the cream-based medicines is a challenge because providing an accurate measured dose is not easy. One common form of a dispenser is a traditional hypodermic syringe, without the needle. The user can depress the plunger to force an amount of cream out of the barrel as indicated by markings on the side of the barrel. For older patients, it is not always easy to measure out 0.1 ml or so of medicine, as this may require more dexterity than is available. In addition, it may be difficult for patients to visually track the amount of liquid dispensed by relying on the markings on the side of the barrel because eyesight may vary from patient to patient. Furthermore, depending on the dispenser, more or less liquid may appear to be dispensed compared to the actual amount dispensed when relying on the markings.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to various examples, a dosing dispenser includes a housing defining a chamber, a traveler within the chamber, and a plunger within the chamber. In some aspects, the traveler is movable along an axis between an engaged position and a disengaged position relative to the plunger, and the traveler is spaced apart from the plunger in the disengaged position.

In some cases, the plunger includes a first end and a second end, the second end of the plunger defines a plunger cavity, and the plunger defines a filling portion of the chamber between the first end of the housing and the first end of the plunger. In certain aspects, the traveler is configured to abut and selectively position the plunger in the engaged position. In various aspects, the traveler includes a first end and a second end, and the first end includes a plunger driver configured to selectively engage the plunger within a plunger cavity of the plunger and movably position the plunger within the chamber.

In various examples, a base assembly is coupled to the housing. In certain examples, the base assembly includes a base and is configured to movably position the traveler within the chamber through rotation of the base. According to some examples, in the disengaged position, the traveler is spaced apart from the plunger, and in the engaged position, a plunger driver of the traveler abuts the plunger within a plunger cavity of the plunger. In various aspects, the housing includes a dispensing channel, the plunger includes a crown, the plunger defines a filling portion of the chamber between the dispensing channel and the plunger, and at least a portion of the crown is positionable within the dispensing channel of the housing when a volume of the filling portion of the chamber is at a minimum. According to certain examples, the housing further includes an intermediate chamber between the chamber and the dispensing channel, and at least a portion of the crown is positionable within the intermediate chamber when the volume of the filling portion of the chamber is at the minimum.

According to some examples, a dosing dispenser includes a housing defining a chamber, a traveler positionable within the chamber, and a plunger positionable within the chamber. In certain cases, the traveler is independently positionable along an axis relative to the plunger in at least one direction within the chamber.

In various aspects, the chamber includes a first end and a second end, the housing further includes a dispensing channel in fluid communication with the chamber at the first end, and the at least one direction is away from the first end. In some cases, the housing further includes a dispensing channel in fluid communication with the chamber, and the at least one direction is away from the dispensing channel. In some examples, the traveler is configured to abut and selectively position the plunger in the a direction opposite the at least one direction.

In certain examples, a base assembly is configured to movably position the traveler within the chamber. In some aspects, the base assembly includes a base, a drive screw threadably engaged with the traveler and coupled to the base such that rotation of the base rotates the drive screw and axially moves the traveler within the chamber, a base support rotatably supporting the drive screw and the base, the base support including a mounting portion and a supporting portion, the supporting portion including at least one notch, and a cam mounted on the drive screw and including at least one extension configured to engage the at least one notch as the cam is rotated through the drive screw. In various aspects, a cross-sectional shape of the plunger is substantially similar to a cross-sectional shape of the chamber such that the plunger forms a fluid tight seal with the housing within the chamber as the plunger is movably positioned within the chamber.

According to certain examples, a method of dispensing a flowable composition with a dosing dispenser includes positioning a plunger within a chamber defined by a housing of the dosing dispenser, positioning a traveler within the chamber such that the traveler is spaced apart from the plunger, and loading the flowable composition within the chamber.

In certain examples, the housing includes a first end and a second end, the first end includes a dispensing channel in fluid communication with the chamber, positioning the plunger within the chamber includes abutting the plunger against the first end of the housing within the chamber, and loading the flowable composition includes loading the flowable composition through the dispensing channel. In some cases, the plunger includes a crown, and positioning the plunger within the chamber includes positioning at least a portion of the crown within the dispensing channel.

In various cases, loading the flowable composition includes loading a predetermined volume of the flowable composition within the chamber between a dispensing end of the housing and a first end of the plunger facing the dispensing end, and the method further includes advancing the traveler within the chamber such that the traveler abuts a second end of the plunger opposite the first end after the predetermined volume is loaded, and dispensing the flowable composition from the dispensing end of the housing by advancing the traveler towards the dispensing end. According to some examples, the method includes positioning the traveler within the chamber such that the traveler abuts the plunger after the flowable composition is loaded, and advancing the traveler within the chamber such that the traveler movably positions the plunger within the chamber and dispenses the flowable composition from the housing.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "forward," "aft," "up," "down," "top," "left," "right," "front," and "back," among others are intended to refer to the orientation as illustrated and described in the figure (or figures) to which the components and directions are referencing.

Disclosed is a dosing dispenser and associated methods, systems, devices, and various apparatus. The dispenser includes a housing, a plunger, a drive screw, and a traveler. It will be understood by those having ordinary skill in the art that the disclosed dispenser is described in but a few examples among many.

To ensure that the dispenser provides an accurate dosage, the patient may be consistently alerted to stop rotation of the drive screw at the appropriate location, and the amount of medicine that is pushed through a dispensing end may not vary due to leaks or fluctuation in the movement of the plunger.

Figure 1:
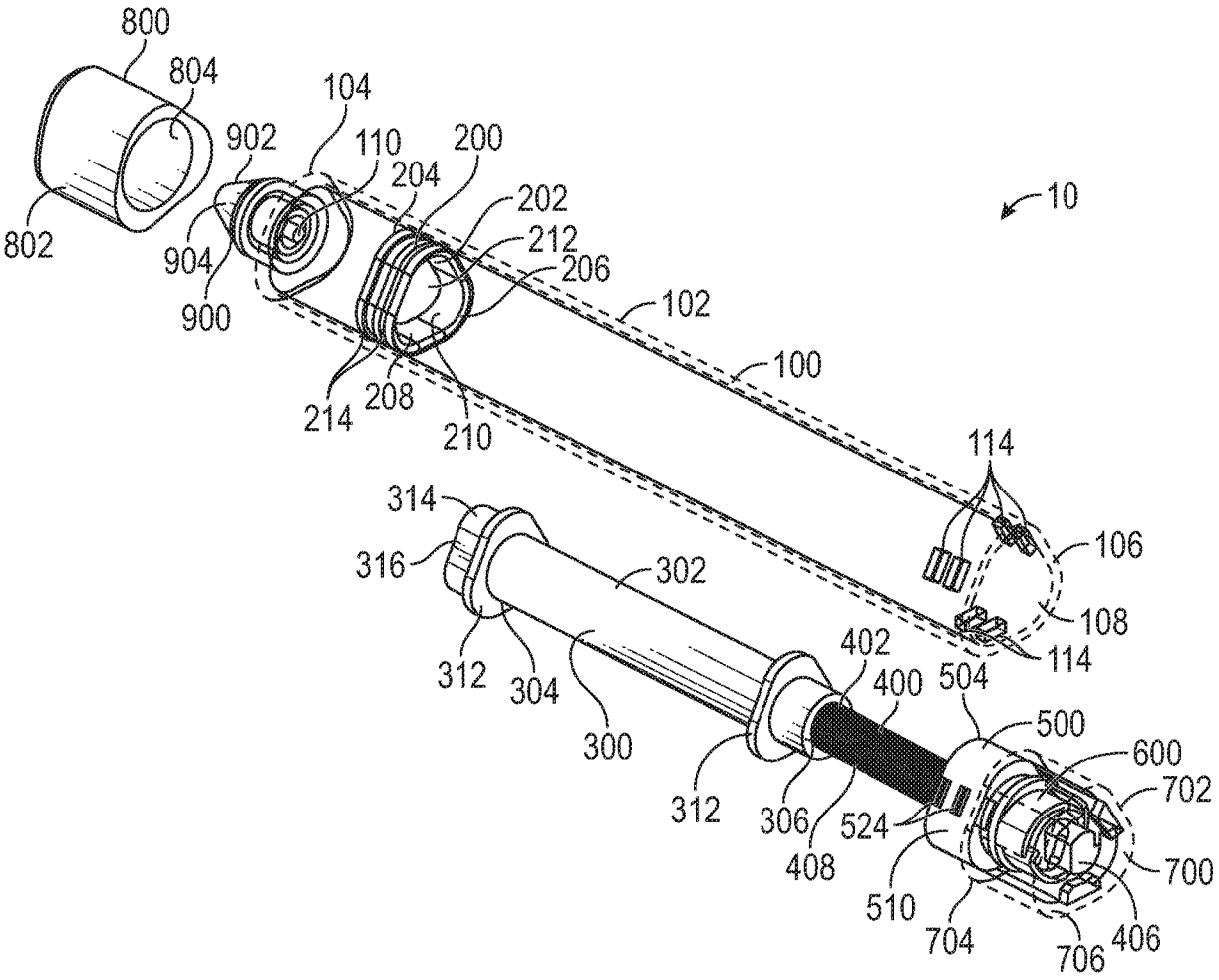
FIG. 1 is a partially-exploded perspective view of a dosing dispenser including a housing, a base assembly, a drive screw, a traveler, an application tool, a cap, and a plunger according to aspects of the present invention.

FIG. 1 illustrates example of a dispenser 10 that is configured to dispense a flowable composition. The flowable composition may include but is not limited to creams or semi-solid emulsions such as oil-in-water creams and water-in-oil creams, gels, sols, colloids, suspensions, solutions, liquids with positive viscosity such as syrups, or other suitable flowable compositions or medicaments. In various examples, the dispenser 10 includes a housing 100, a plunger 200, a traveler 300, a drive screw 400, a base support 500, a cam 600, a base 700, a cap 800, and an applicator 900. Some or all of the parts that comprise the dispenser 10 may be formed of materials including but not limited to polymer, plastic, composite, or other formable or moldable material.

As illustrated in FIG. 1, the housing 100 includes a body 102 having a first end 104 and a second end 106. In various aspects, the body 102 defines a chamber 108 extending from the first end 104 to the second end 106 that is dimensioned and configured to store the flowable composition. The chamber 108 may have any cross-sections desired. In some cases, a shape of the chamber 108 may be different from an exterior shape of the body 102. In some examples, the exterior shape of the body 102 may be oval, elliptical, triangular, square, hexagonal, pentagonal, circular, rectilinear, parabolic, hexagonal, other polygonal, irregular circular, or any other desired shape. In some cases, the body 102 is an ergonomic shape.

In various examples, the first end 104 is a dispensing end of the housing 100 that includes a dispensing aperture 110. As described in detail below, during use of the dispenser 10, the flowable composition may flow into or out of the chamber 108 through the dispensing aperture 110.

Figure 18:
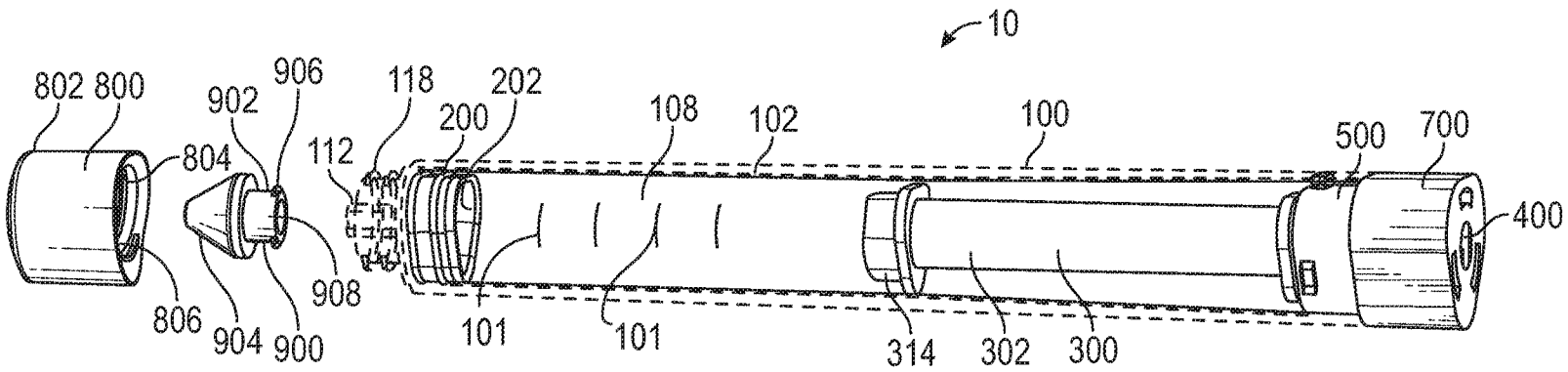
FIG. 18 is a partially exploded assembly view of the dispenser of FIG. 1 with the cap and application tool removed.
Figure 19:
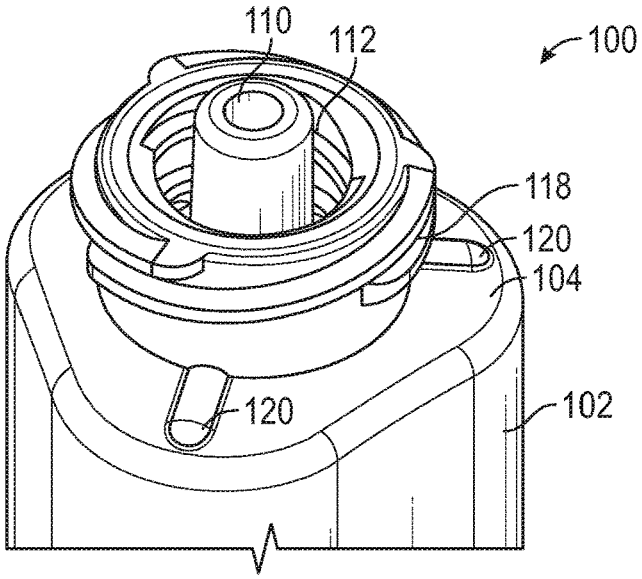
FIG. 19 is a perspective view of a dispensing end of the housing.
Figure 20:
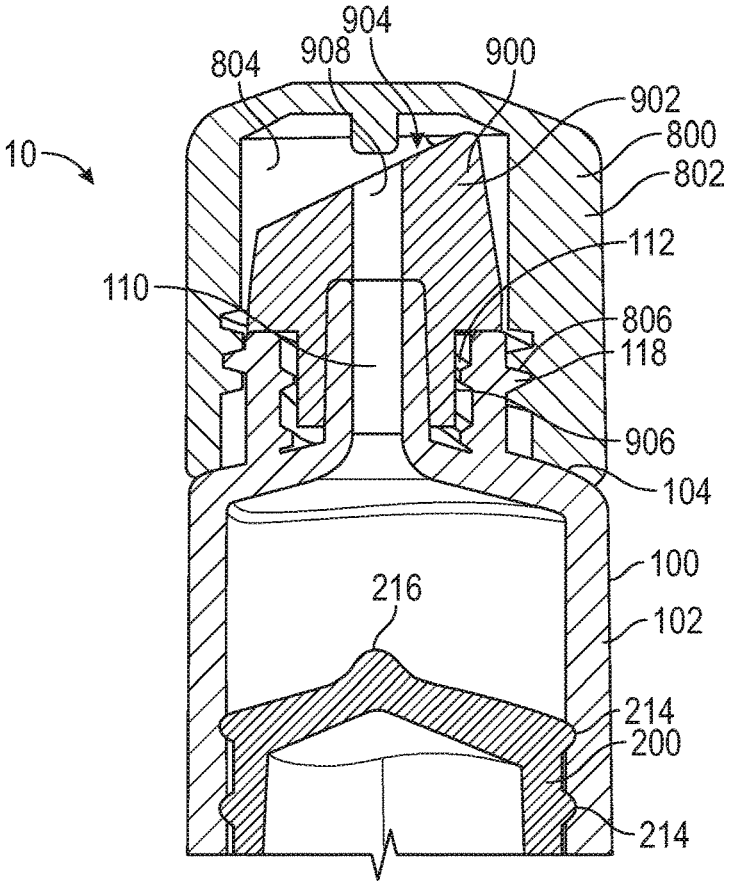
FIG. 20 is an enlarged sectional view of a portion of the dispenser of FIG. 1 including the plunger, housing, cap, and application tool.

In various examples, the first end 104 of the housing 100 also includes an applicator locking interface 112 (see, e.g., FIGS. 18-20). In some examples, the locking interface 112 has a male Luer-style surface (see, e.g., FIGS. 28-31) or a female Luer-style surface (see, e.g., FIGS. 19-20). In these examples, and as described below, the applicator 900 may include a locking interface 906 that is complimentary to the locking interface 112 of the housing 100. In various cases, the locking interface 112 may also optionally include anti-rotation ribs 122. In these examples, the anti-rotation ribs 122 may provide an interface that resists casual rotation of the applicator 900 while the dispenser 10 is being used. In some cases where the locking interface 112 includes the anti-rotation ribs 122, the applicator 900 may optionally include complimentary anti-rotation grooves (not shown) that are configured to engage with the anti-rotation ribs 122. In various examples, the anti-rotation ribs 122 may be provided on the applicator 900 and the first end 104 may include the complimentary anti-rotation grooves.

In some examples, the first end 104 may also include threading 118 that is configured to engage with threading 806 of the cap 800. In various cases, the first end 104 may optionally comprise ribs 120 that are configured to engage with grooves 808 of the cap 800 to provide a stopping interface and align a shape of the cap 800 with a shape of the housing 100. In other examples, the grooves may be provided on the first end 104 and the ribs 120 may be provided on the cap 800.

In various examples (see, e.g., FIGS. 1 and 21), the housing 100 may optionally include mounting slots 114 that are configured to engage the base support 500 in a snap-fit configuration. In some cases, the mounting slots 114 are provided proximate to the second end 106 of the housing 100, although they need not be. It will be appreciated that the disclosure of mounting slots 114 should not be considered limiting on the current disclosure as in various other examples, various other suitable mounting mechanisms may be utilized to assemble the base support 500 with the housing 100.

Figure 5:
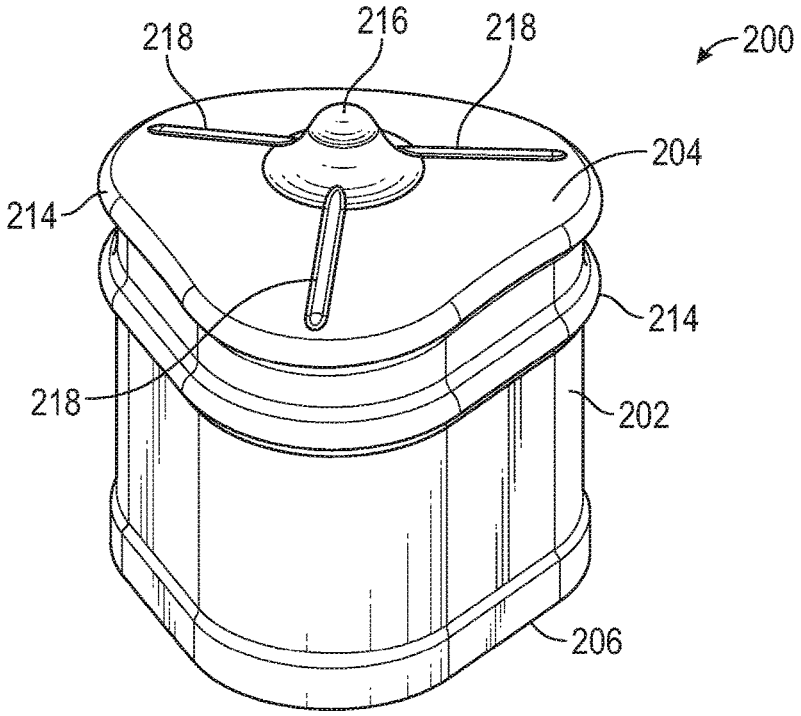
FIG. 5 is a perspective view of the plunger of FIG. 1.
Figure 6:
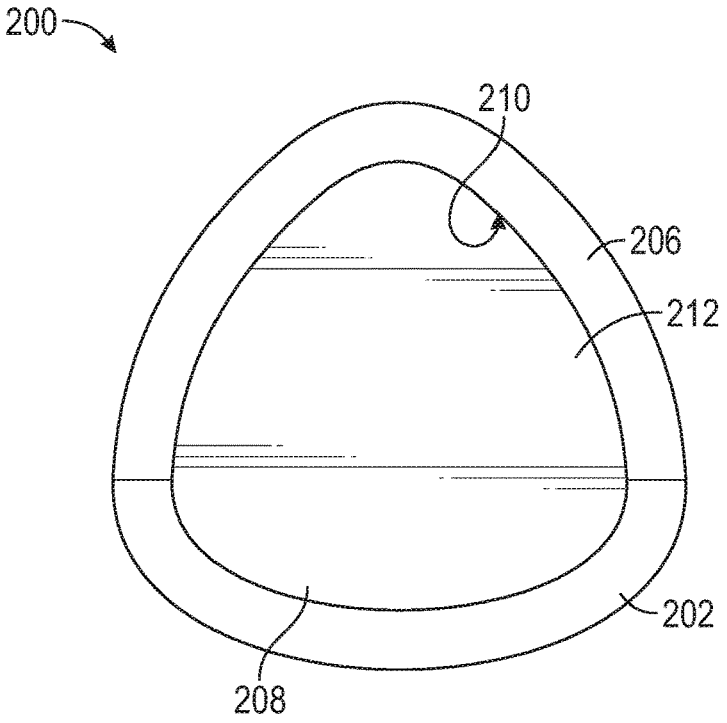
FIG. 6 is an end view of the plunger of FIG. 5.
Figure 7:
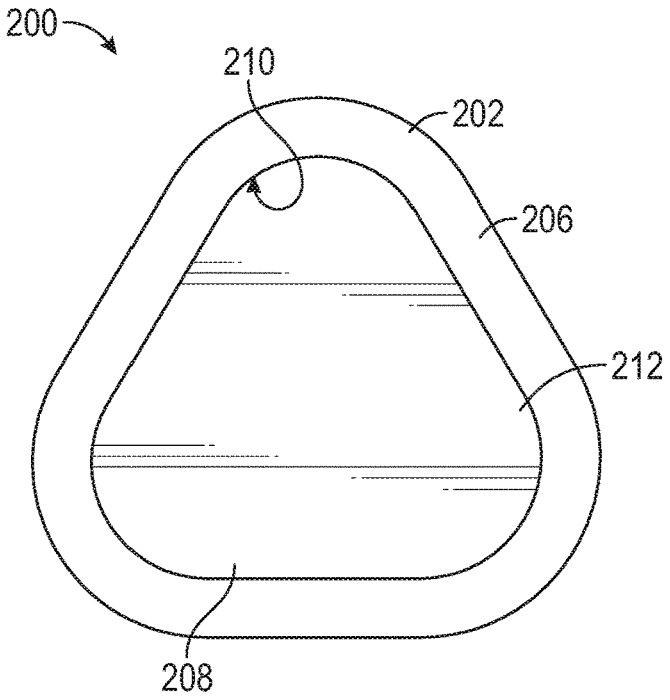
FIG. 7 is an end view of a plunger for a dosing dispenser according to an example of the present invention.

As illustrated in FIGS. 1, 5, and 6, the plunger 200 includes a body 202 having a first end 204 and a second end 206. The shape of the plunger 200 is selected such that the body 102 of the housing 100 and the plunger 200 may form a fluid tight seal within the chamber 108 and engage with each other in a way that prevents the plunger 200 from freely rotating within the chamber 108 as the plunger 200 is moved axially along the chamber 108, as described in detail below. For example and without limitation, in some examples, the chamber 108 and the plunger 200 may have any suitable interlocking shapes such as oval, elliptical, triangular, rectilinear, parabolic, hexagonal, other polygonal, irregular circular, or any other interlocking shapes. As one non-limiting example, FIG. 6 illustrates the plunger 200 having one cross-sectional profile shape, and FIG. 7 illustrates a plunger 200 having another cross-sectional profile shape.

The plunger 200 is shaped to snugly fit within the chamber 108 without freely rotating within the chamber 108. In certain embodiments, the chamber 108 may have some variation in size from top to bottom, with the second end typically being slightly smaller in cross-sectional area than the first end. Also, there may be some variation in sizes among chambers 108 and plungers 200. Therefore, the plunger 200 is configured with a flexible design that provides a fluid tight seal along the entire length of the chamber 108 and between variations among housing 100 sizes. In these embodiments, the plungers 200 may be formed to have a greater degree of flexibility that allows the plunger 200 to bend or compress as needed to form a fluid tight seal inside smaller cross-section areas, and to flex or expand as needed to form a fluid tight seal inside larger cross-section areas.

In certain embodiments, the plunger 200 includes a sealing member 214 that includes a flexible design configured to flexibly bend, compress, flex, and/or expand as needed to allow the plunger 200 to maintain a fluid tight seal within the chamber 108. In the present example, the plunger 200 includes two sealing members 214, although it will be appreciated that any desired number of sealing members 214, including zero sealing members 214, may be used.

As illustrated in FIG. 5, in various cases, the first end 204 of the plunger 200 may optionally include a crown 216. The crown 216 may be provided to reduce the volume of residual flowable composition within the chamber 108 after use of the dispenser 10. In some examples, the crown 216 may partially extend into the dispensing aperture 110 before the chamber 108 is filled with the flowable composition, at various positions or dosages while or after the flowable composition is being dispensed, or both. In some cases, the crown 216 may be provided to provide resistance to fold-over of the plunger 200 during filling of the chamber 108 with the flowable composition. In other cases, the first end 204 of the plunger 200 may be flat, arcuate, angled, or have various other suitable shapes as desired.

In some examples, the first end 204 of the plunger 200 may also include ribs 218. The ribs 218 may provide air passages between adjacent ribs 218 which may allow for pressure to build up across the first end 204 and reduce the initial force needed to start filling the chamber 108 with the flowable composition.

In various cases, second end 206 of the plunger 200 defines a cavity 208 having a cavity sidewall 210 and a cavity end wall 212. The cavity 208 is dimensioned and configured to engage a plunger driver 314 of the traveler 300 such that the plunger 200 is movably positioned within the chamber 108 through the traveler 300. In various cases, a skirt of the plunger 200, or the portion of the body that extends from the cavity end wall 212 to the second end 206, is provided to reduce fold-over or rotation of the plunger 200 during filling or dispensing of the flowable composition. In various examples, the plunger 200 is configured to be positioned within the chamber 108 such that the first end 204 of the plunger 200 faces the first end 104 of the housing 100 and the second end 206 faces the second end 106 of the housing 100.

Figure 2:
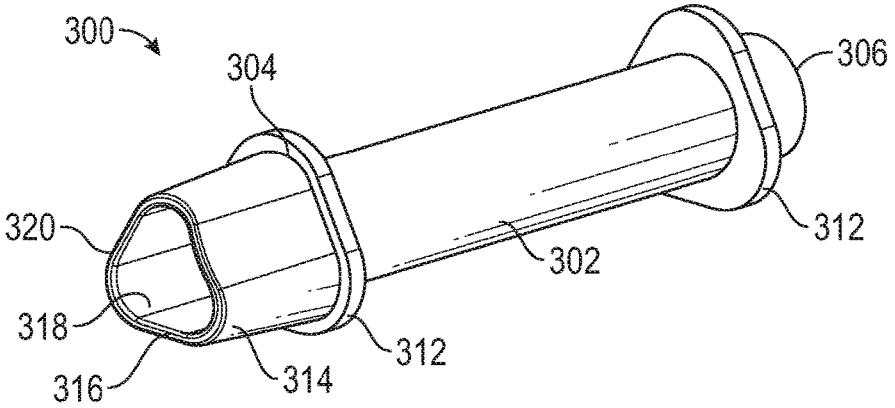
FIG. 2 is a perspective view of the traveler of FIG. 1.
Figure 3:
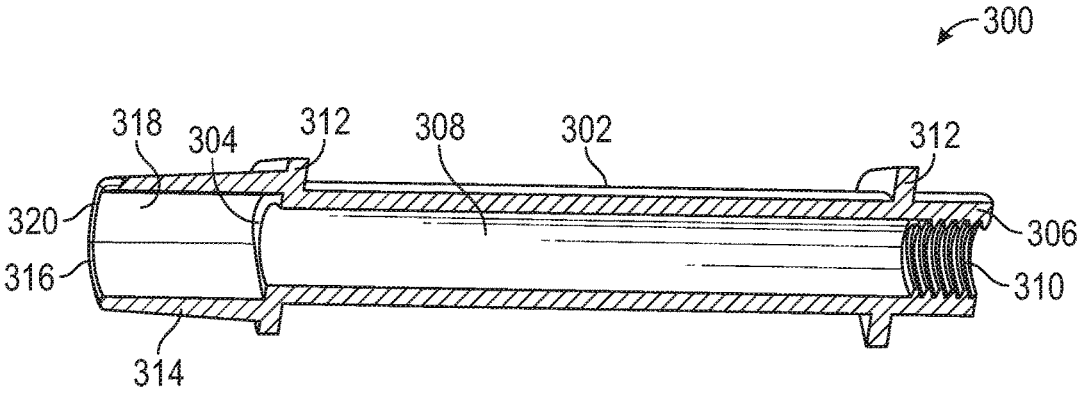
FIG. 3 is a sectional view of the traveler of FIG. 2.

Referring to FIGS. 1-3, the traveler 300 includes a body 302 having a first end 304 and a second end 306. In various aspects, the body 302 defines a chamber 308 that extends from the first end 304 to the second end 306. The chamber 308 is shaped and dimensioned to accommodate the drive screw 400, as described in detail below. In some aspects, the chamber 308 includes threading 310 that are configured to threadably engage the drive screw 400. In various cases, at least a portion of the chamber 308, such as a portion of the chamber 308 proximate to the second end 306, includes the threading 310. In other cases, the threading 310 may be provided throughout the chamber 308 from the first end 304 to the second end 306.

In various examples, the traveler 300 includes collars 312 at various positions on the body 302. The collars 312 have a shape that is complimentary to the shape of the chamber 108 of the housing 100 such that rotation of the traveler 300 is resisted as the drive screw 400 moves the traveler 300 axially along the drive screw 400 within the chamber 108. The number of collars 312, the shape of the collars 312, or the location of the collars 312 on the body 302 should not be considered limiting on the present disclosure. In the present example, the traveler 300 includes two collars 312A and 312B. In this example, the collar 312B is proximate to the second end 306 of the body 302 and the collar 312A is proximate to the first end 304.

In some cases, the traveler 300 includes a plunger driver 314 extending from proximate the first end 304. The plunger driver 314 is shaped and dimensioned such that the plunger driver 314 may engage the plunger 200 within the plunger cavity 208 to movably position the plunger 200 within the chamber 108. In various cases, an end 316 of the plunger driver 314 is configured to engage the plunger 200. Thus, the plunger driver 314 may have a cross-sectional profile shape that is complimentary to the shape of the plunger cavity 208. In various cases, the plunger driver 314 may optionally define a plunger drive chamber 318 that is in fluid communication with the chamber 308. In such cases, the end 316 of the plunger driver 314 may define an opening 320, as illustrated in FIGS. 2 and 3. However, in other examples, the end 316 may be solid. In various other cases, the entire plunger driver 314 may be solid (i.e. the plunger driver 314 does not define a plunger drive chamber 318).

Figure 4:
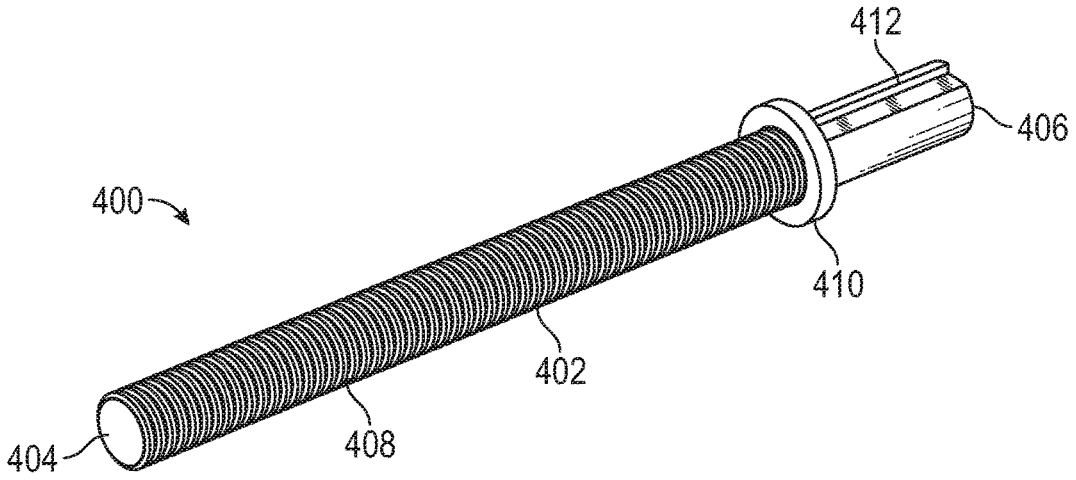
FIG. 4 is a perspective view of the drive screw of FIG. 1.

As illustrated in FIG. 4, the drive screw 400 includes a body 402 having a first end 404, a second end 406, and a support collar 410 between the first end 404 and the second end 406. In various cases, the body 402 includes threading 408 between the first end 404 and the support collar 410 that are configured to threadably engage the threading 310 of the traveler 300 such that rotation of the drive screw 400 axially moves the traveler 300 along the body 402. In various cases, at least a portion of the body 402 between support collar 410 and the second end 406 is a key 412 having a key profile that is configured to engage the base 700 such that rotation of the base 700 rotates the drive screw 400, as described in detail below.

Figure 8:
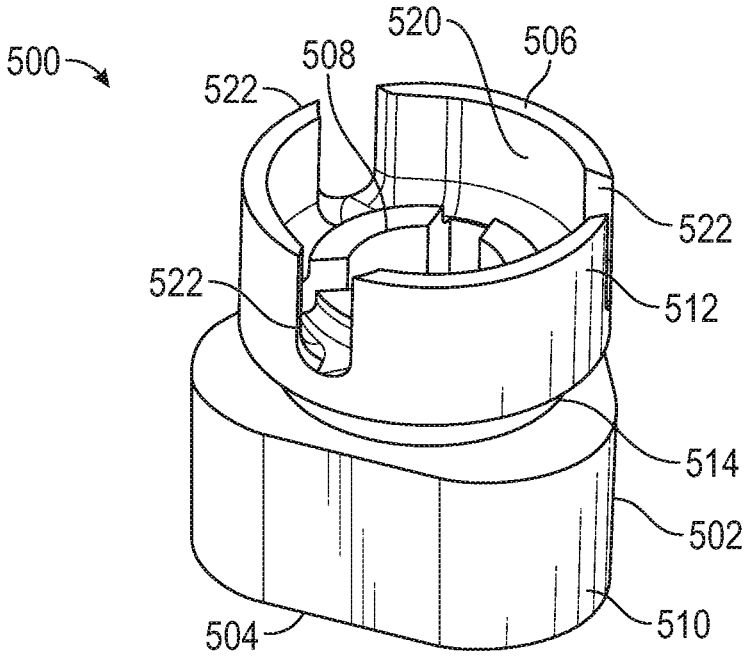
FIG. 8 is a perspective view of a base support of the base assembly of FIG. 1.
Figure 9:
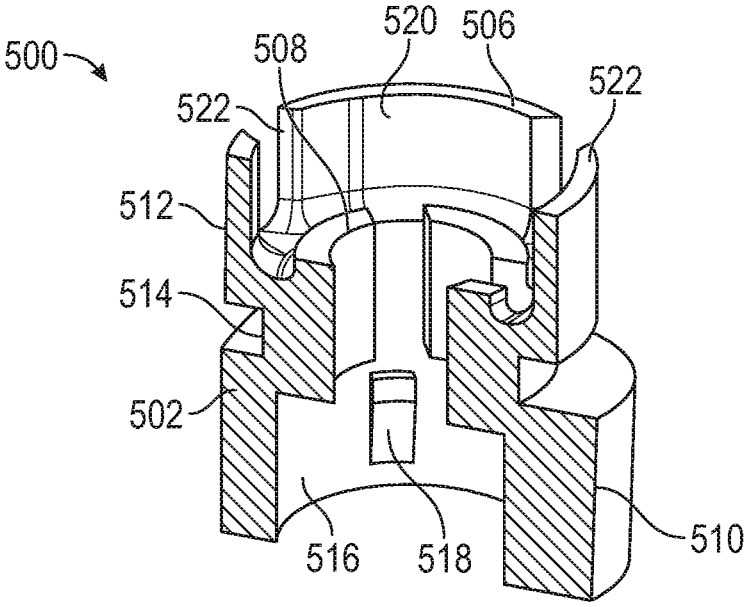
FIG. 9 is a sectional view of the base support of FIG. 8.
Figure 10:
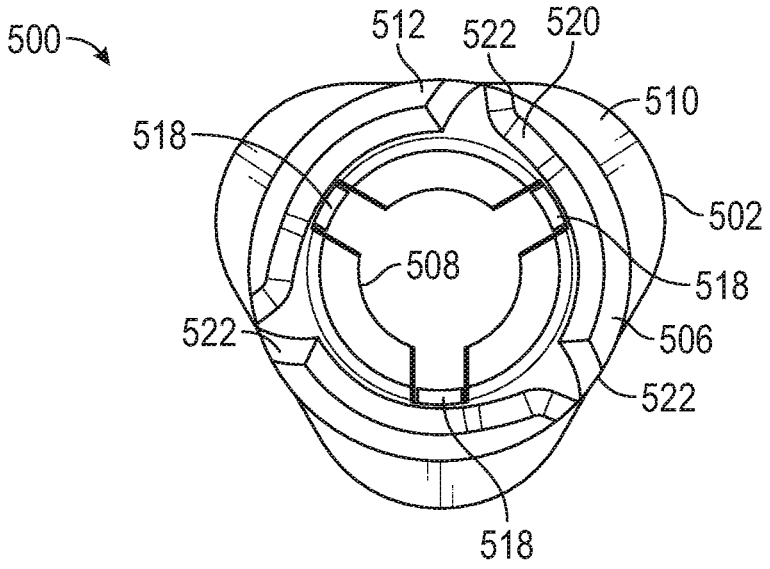
FIG. 10 is an end view of the base support of FIG. 8.

Referring to FIGS. 8-10, the base support 500 includes a body 502 having a first end 504 and a second end 506. In various cases, the body 502 defines a central opening 508 extending through the body 502 from the first end 504 to the second end 506 that is dimensioned to accommodate the drive screw 400. In some cases, the body 502 has a mounting portion 510 proximate to the first end 504 and a supporting portion 512 proximate to the second end 506. In various examples, the base support 500 optionally defines an attachment groove 514 between the mounting portion 510 and the supporting portion 512 that is configured to engage the base 700 such that the base 700 is rotatably supported on the base support 500, as described in detail below.

As illustrated in FIGS. 8-10, in some cases, the mounting portion 510 and the supporting portion 512 may have different cross-sectional profile shapes. In other cases, the mounting portion 510 and the supporting portion 512 may have similar cross-sectional profile shapes. In the present example, the mounting portion 510 has a profile shape that is complimentary to the shape of the chamber 108 such that the mounting portion 510 may be inserted into the chamber 108 to couple the base support 500 with the housing 100. Optionally, in this example, the mounting portion 510 may include engagement projection 524 which are configured to engage the mounting slots 114 of the housing 100 in a snap-fit engagement. This engagement may also resist rotation of the base support 500 during use. It will be appreciated that in various other examples, various other suitable attachment mechanisms for engaging the base support 500 with the housing 100 may be used, such as screws, pins, bolts, dips, clasps, etc.

The mounting portion 510 defines a mounting portion cavity 516 that is dimensioned and configured to accommodate the support collar 410 of the drive screw 400. In sonic cases, mounting projections 518 are provided within the mounting portion cavity 516 to retain the drive screw 400 axially relative to the base support 500 while allowing for rotation of the drive screw 400 relative to the base support 500. In some cases, the mounting projections 518 provide a snap-fit engagement with the support collar 410 of the drive screw 400. In various other examples, other suitable mechanisms for retaining the drive screw 400 relative to the base support 500 while allowing for rotation of the drive screw 400 relative to the base support 500 may be used.

The supporting portion 512 defines a supporting portion cavity 520 that is dimensioned and configured to accommodate the cam 600. As illustrated in FIGS. 8-10 and 12, the supporting portion 512 defines notches or slots 522 that are configured to engage arms 606 of the cam 600, as described in detail below. The number of shape of the slots 522 should not be considered limiting on the current disclosure. The slots 522 define one or more home or "click" positions that are provided at predetermined intervals on the supporting portion 512. The intervals of the slots 522 may correspond with a predefined amount of flowable composition is dispensed from the dispenser 10 upon rotation of the drive screw 400 between successive home positions, as described in detail below. In some cases, the slots 522 may be omitted and a sidewall of the supporting portion 512 may define projections and recesses that are configured to engage with the cam 600 in a similar manner (see FIGS. 46-51).

Figure 11:
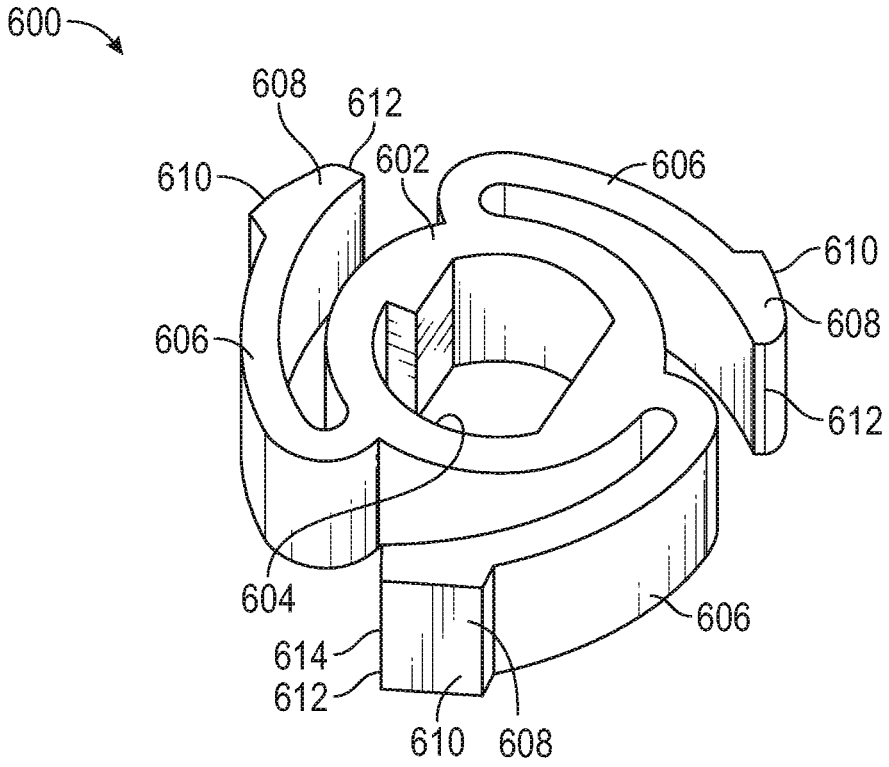
FIG. 11 is an end view of a cam of the base assembly of FIG. 1.
Figure 12:
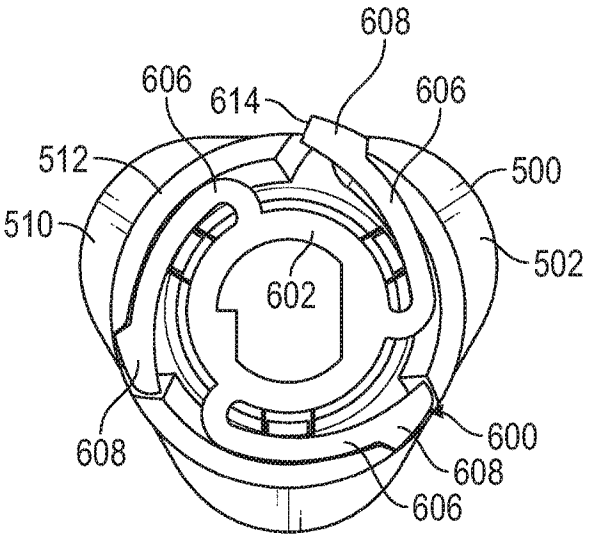
FIG. 12 is an end view of the cam of FIG. 11 mounted on the base support of FIG. 8.

Referring to FIG. 11, the cam 600 includes a body 602 that defines a keyhole 604. The keyhole 604 has a shape that is complimentary to the key 412 of the drive screw 400 such that the key 412 is insertable through the keyhole 604, and rotation of the drive screw 400 rotates the cam 600. As illustrated in FIGS. 11 and 12, the cam 600 includes at least one arm 606. In the present example, the cam 600 includes three arms 606. Some or all of the arms 606 may have the same engagement end 608, or each arm 606 may have a different engagement end 608, depending on the purpose of each arm 606. In various cases, the cam 600 may include the same number of arms 606 as the number of slots 522 of the base support 500.

In various cases, at least one engagement end 608 includes a projection 610 and a trailing edge 612. In some cases, the trailing edge 612 is configured to engage the supporting portion 512 when the projection 610 is within one of the slots 522 to prevent rotation of the cam 600 in the direction of the trailing edge 612. The trailing edge 612 may have various suitable profiles and geometries that provide an interface that resists rotation of the cam 600 in the direction of the trailing edge 612 when the projections 610 are within the slots 522. In some cases, the trailing edge 612 may have a profile that engages the supporting portion 512 such that the arms 606 of the cam 600 will break before allowing back rotation.

In some cases, at least one projection 610 also has a clicking profile 614. In various examples with multiple arms 606, one, some, or all of the projections 610 may have the clicking profile 614. The clicking profile 614 is configured to sufficiently radially bend the engagement end 608 so as to emit an audible "click" when the engagement end 608 returns to an unbent stage after travelling over the supporting portion 512 and engages one of the slots 522. Thus, in certain embodiments, the interaction between at least one of the projections 610 with the clicking profile 614 and at least one of the slots 522 may provide the audible "click" response, while the interaction between at least one of the projections 610 without the clicking profile 614 merely provide the anti-reverse rotation feature.

The interaction between at least one of the projections 610 with the clicking profile 614 and at least one of the slots 522 may also provide tactile feedback. In other embodiments, the interaction between at least one of the projections 610 without the clicking profile 614 (or with an additional clicking profile 614) may provide a back-up audible "click" to the audible "click" that is also emitted by the interaction between at least one of the projections 610 with the clicking profile 614 and at least one of the slots 522. As described in detail below, the auditory and/or tactile feedback from the interaction between at least one of the projections 610 with the clicking profile 614 and at least one of the slots 522 may alert the user that a predetermined amount of the flowable composition was dispensed.

The base 700 includes a body 702 having a first end 704 and a second end 706. The base 700 may have a profile shape that is similar to the profile shape of the base support 500 and/or the housing 100, although it need not. In various other cases, the base 700 may have any desired profile shape. The base 700 defines a keyhole 708 that is dimensioned to accommodate and receive the key 412 of the drive screw 400. The base 700 defines a base cavity 710 that is configured to accommodate the cam 600 and the supporting portion 512. In some aspects, the base 700 includes projections 712 which are configured to engage the attachment groove 514 such that the base 700 is retained on the base support 500 while being rotatable relative to the base support 500. In various other examples, various other mounting mechanisms may be utilized.

When assembled on the base support 500, the base 700 retains the cam 600 on the drive screw 400 between the base support 500 and the base 700. In sonic cases, the base 700 may provide visual feedback to the user to indicate when at least one of the projections 610 with the clicking profile 614 is engaged with at least one of the slots 522. For example, in some cases where the base 700has a profile shape that is similar to the profile shape of the base support 500 and/or the housing 100, the base 700 may provide visual feedback that the at least one projection 610 is not engaged with the slot 522 when the profile of the base 700 is misaligned with the profile of the base support 500 and/or the housing 100. In a similar manner, the base 700 may provide visual feedback that the at least one projection 610 is engaged within the slot 522 when the profile of the base 700 is aligned with the profile of the base support 500 and/or the housing 100. Various other visual feedback may be provided by the base 700 when compared to the base support 500 and/or the housing 100.

Figure 13:
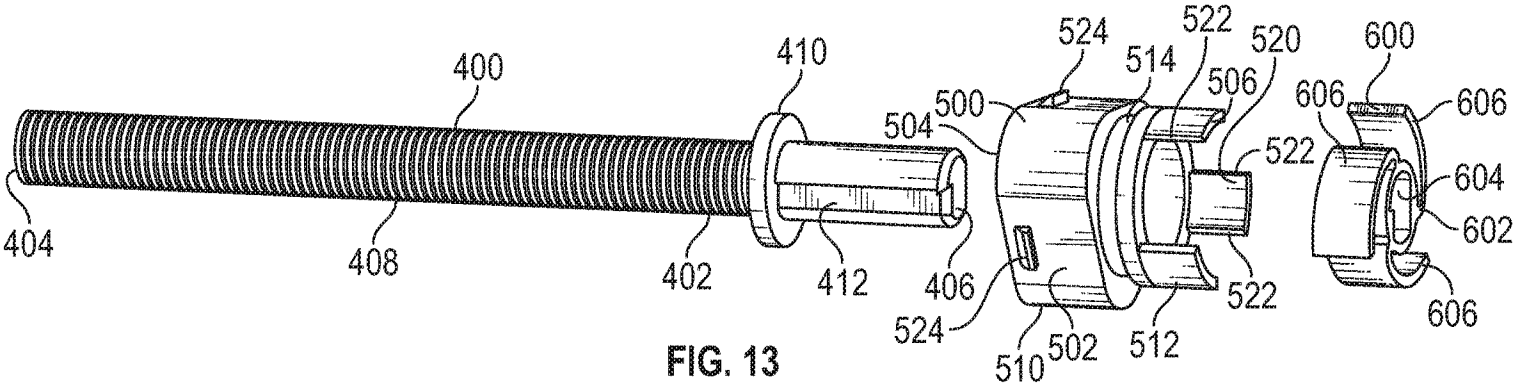
FIG. 13 is an exploded assembly view of the drive screw of FIG. 1 with the base support of FIG. 8 and the cam of FIG. 11.

FIGS. 13-18 illustrate another non-limiting example of steps for assembling the dispenser 10. In FIG. 13, the drive screw 400 is inserted through the central opening 508 of the base support 500 and the support collar 410 of the drive screw 400 is snap-fit into the mounting portion cavity 516 of the base support 500. The keyhole 604 of the cam 600 is aligned with the key 412 of the drive screw 400 and the cam 600 is slid onto the drive screw 400.

Figure 14:
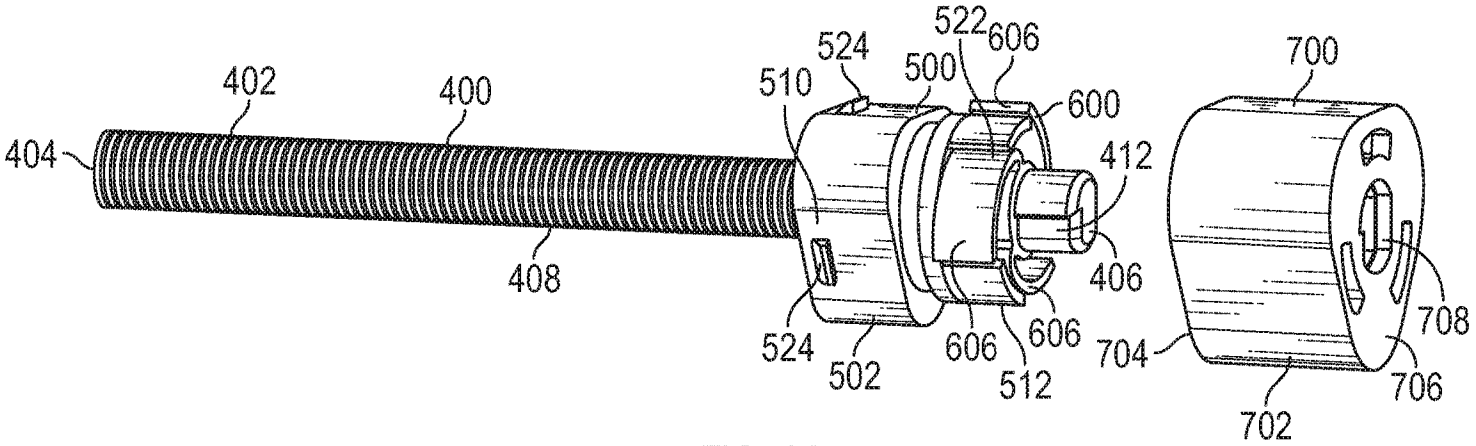
FIG. 14 is a partially exploded assembly view of the drive screw, base support, and cam of FIG. 13 with a base of the base assembly of FIG. 1.
Figure 15:
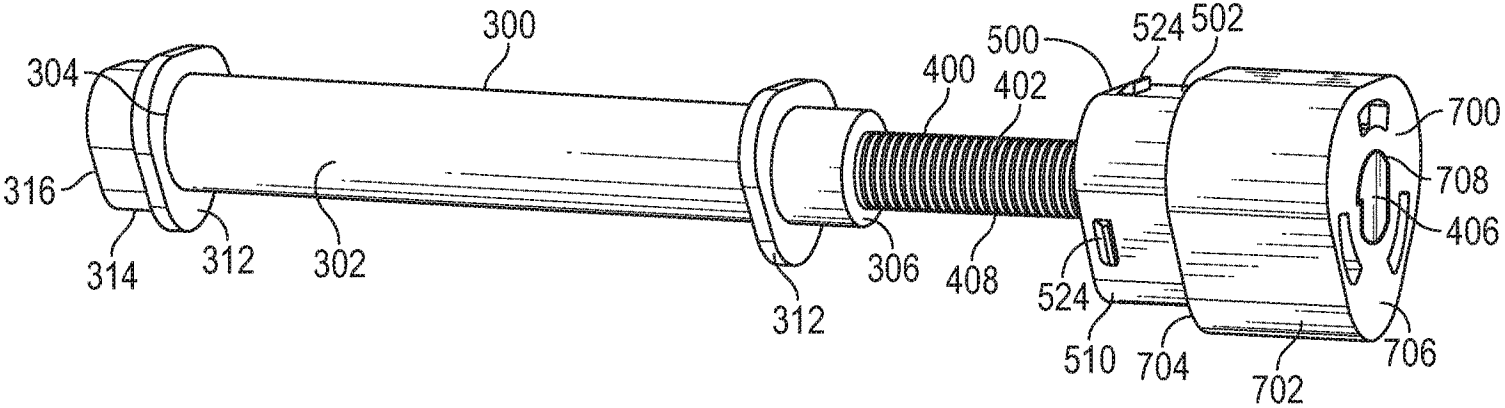
FIG. 15 is a perspective view of the drive screw, base support, cam, and base FIG. 14 with the traveler of FIG. 1.
Figure 16:
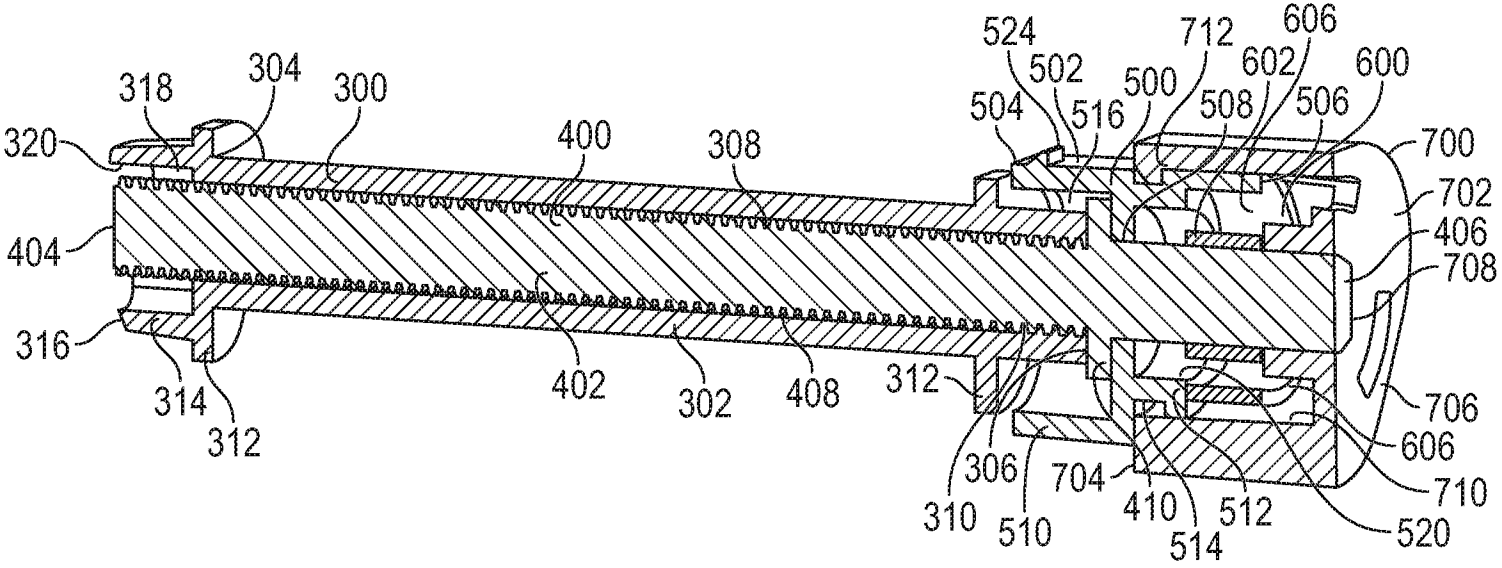
FIG. 16 is a sectional view of the drive screw, base support, cam, base, and traveler of FIG. 15.

In FIG. 14, the base 700 is rotatably mounted on the base support 500 such that the cam 600 is captured on the drive screw 400 between the base 700 and the base support 500. In FIGS. 15 and 16, the traveler 300 is threaded onto the drive screw 400 and run along the drive screw 400 such that the second end 306 of the traveler 300 is relatively close to the support collar 410 of the drive screw 400. In some cases, the second end 306 may abut the support collar 410, although it need not.

Figure 17:
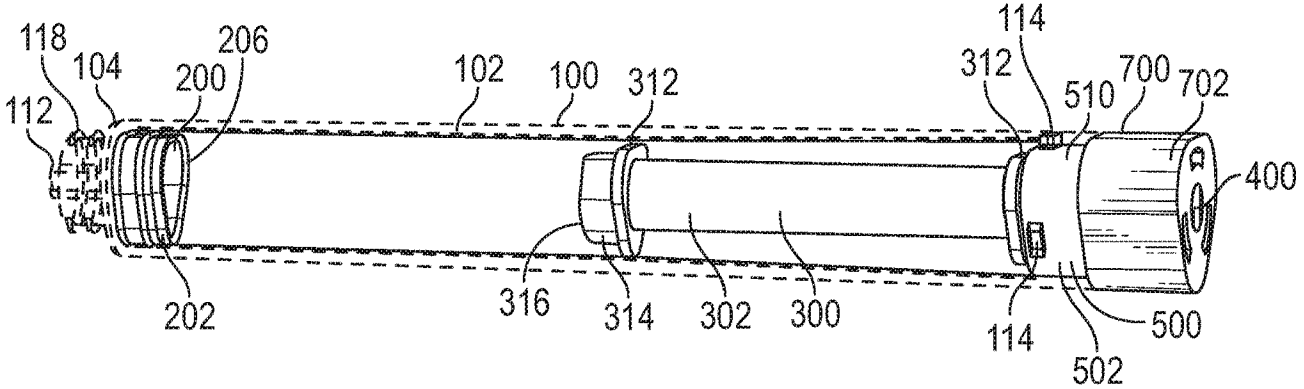
FIG. 17 is a perspective view of the driver screw, base support, cam, base, and traveler of FIG. 15 with the housing and plunger of FIG. 1.

In FIG. 17, the plunger 200 is inserted into the chamber 108 of the housing 100 such that the first end 204 of the plunger 200 faces the first end 104 of the housing 100 and the second end 206 of the plunger 200 faces the second end 106 of the housing 100. In some cases, the plunger 200 is inserted such that the first end 204 abuts the first end 104 of the housing 100 within the chamber 108. In various examples where the plunger 200 includes the crown 216, a portion of the crown 216 may be inserted into the dispensing aperture 110 of the housing 100. The base support 500, which indirectly supports the traveler 300, the drive screw 400, the cam 600, and the base 700, is coupled to the housing 100. In the present embodiment, the base support 500 is coupled to the housing 100 by inserting the mounting portion 510 of the base support 500 within the chamber 108 and snap-fitting the engagement projections 524 of the mounting portion 510 with the mounting slots 114 of the housing 100. As described in detail below, various other mounting mechanisms and configurations may be used to mount the base support 500, traveler 300, drive screw 400, cam 600, and base 700 to the housing 100.

In FIG. 18, the desired applicator 900 is attached to the first end 104 of the housing 100. In addition, the cap 800 is removably attached to the housing 100 at the first end 104.

The cap 800 includes a body 802 that defines a cavity 804. In various aspects, at least a portion of the cavity 804 includes threading 806 that is configured to engage the threading 118 of the housing 100. As described previously, in some cases, the cap 800 includes grooves 808 that are configured to engage the ribs 120 to provide a stopping interface and align a shape of the cap 800 with a shape of the housing 100. In other examples, the grooves may be provided on the first end 104 and the ribs 120 may be provided on the cap 800.

Figure 27:
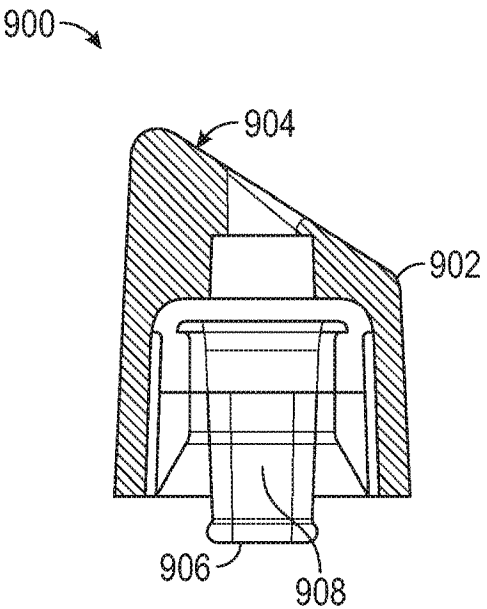
FIG. 27 is sectional view of another application tool according to aspects of the present invention.
Figure 26:
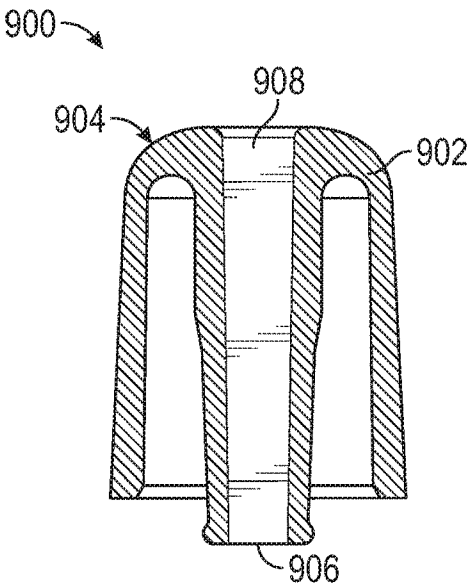
FIG. 26 is sectional view of another application tool according to aspects of the present invention.
Figure 25:
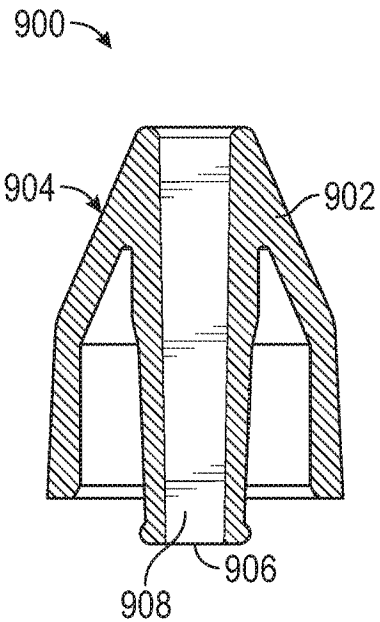
FIG. 25 is sectional view of an application tool according to aspects of the present invention.
Figure 28:
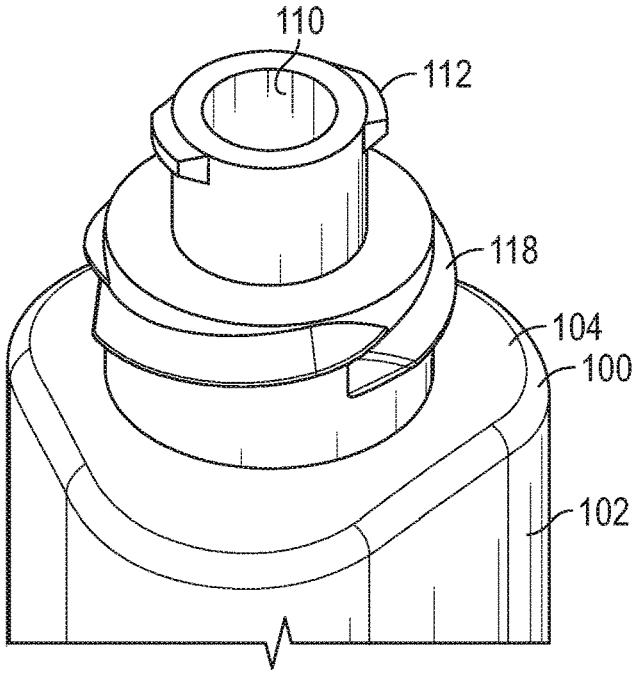
FIG. 28 is a perspective view of a portion of a housing of a dispenser according to aspects of the present invention.
Figure 29:
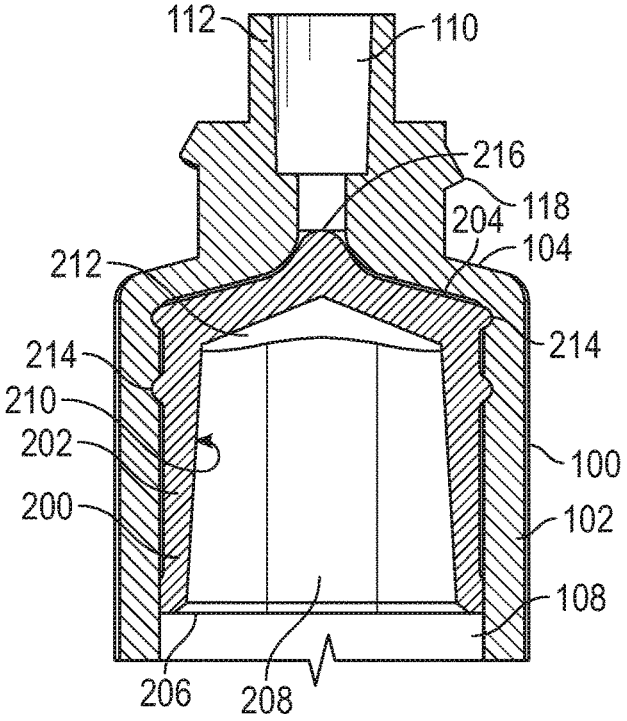
FIG. 29 is an enlarged sectional view of the portion of the housing of FIG. 28 with a plunger.

The applicator 900 includes a body 902 having an applicator surface 904 and a housing locking interface 906. A dispensing channel 908 is defined through the body 902. As illustrated in FIGS. 25-27, the applicator surface 904 may have various profiles depending on an intended use of the dispenser 10. For example and without limitation, the applicator surface 904 may have an angled profile (see, e.g., FIGS. 25 and 27), arcuate profile (see, e.g., FIG. 26), ribbed profile, flat profile, or various other suitable profiles as desired.

The housing locking interface 906 is complimentary to the applicator locking interface 112. For example, in some cases, the locking interface 906 may be a male Luer-style interface or a female Luer-style interface. In some cases, the locking interface 906 (or the locking interface 112) may be tamper-proof such that a user may not remove the applicator 900 after a doctor or other person initially fills the dispenser with the flowable composition and attaches the applicator 900 to the housing 100. When assembled, the dispensing channel 908 is in fluid communication with the chamber 108 and dispensing aperture 110 of the housing 100.

Figure 21:
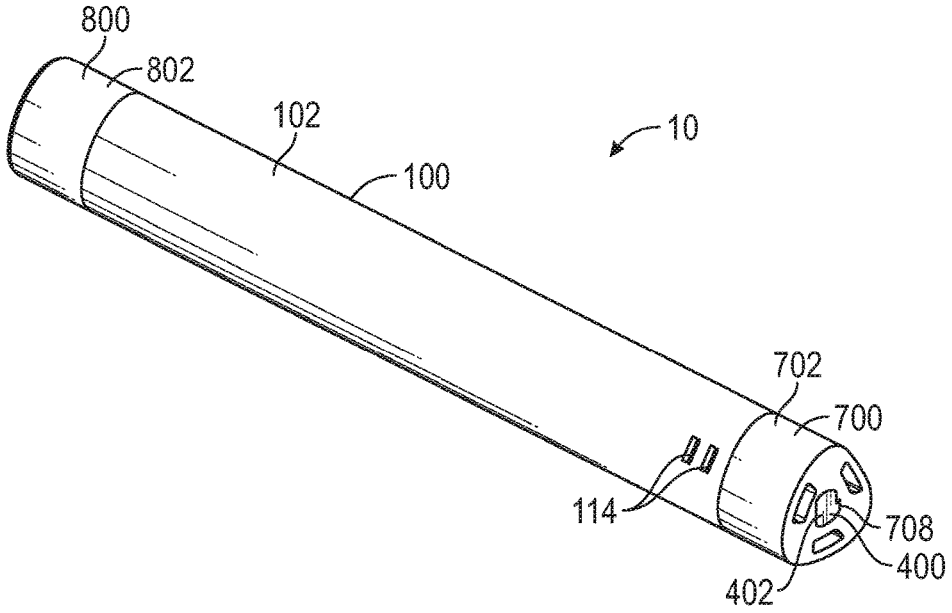
FIG. 21 is a perspective view of the dispenser of FIG. 1.

FIGS. 19 and 20 illustrate the applicator locking interface 112 and the applicator locking interface 112 engaged with the housing locking interface 906. FIG. 21 illustrates the dispenser 10 fully assembled and with the cap 800 attached.

Figure 22:
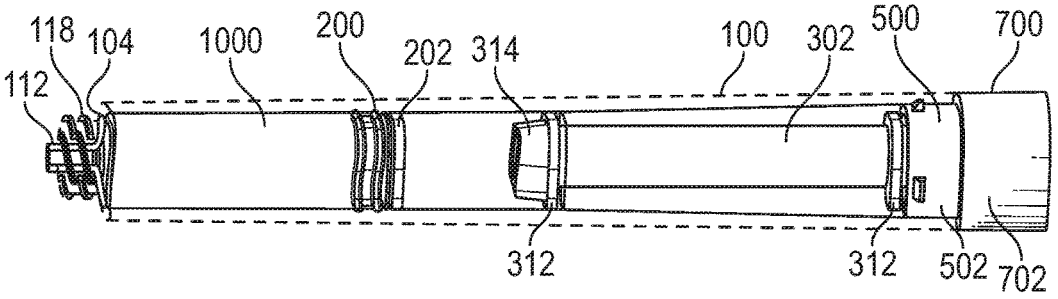
FIG. 22 is a perspective view of the dosing dispenser of FIG. 1 with the cap and application removed, a flowable composition in the housing, and the plunger and traveler in a first position.
Figure 23:
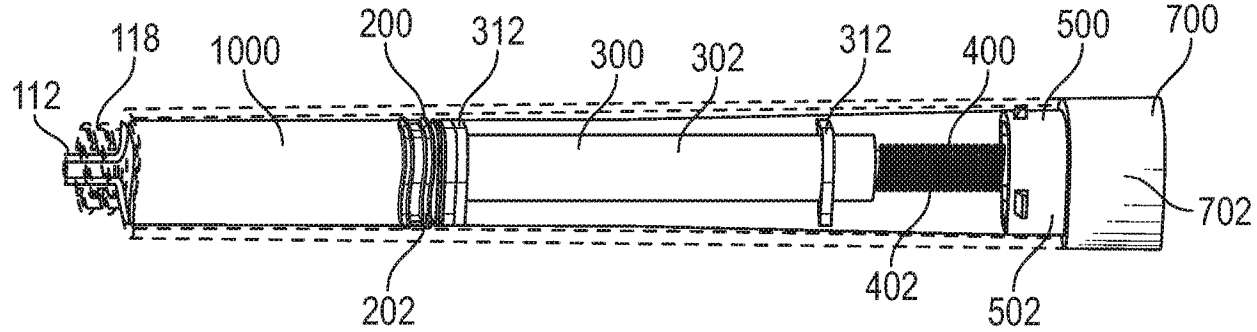
FIG. 23 is perspective view of the dosing dispenser of FIG. 22 with the plunger and traveler in a second position.
Figure 24:
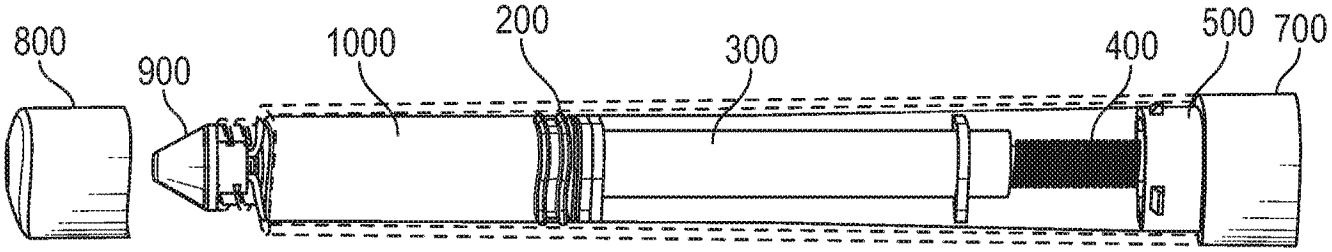
FIG. 24 is a perspective view of the dosing dispenser of FIG. 23 with the application tool attached to the housing and the cap removed.

FIGS. 22-24 illustrate steps for dispensing a flowable composition 1000 using the dispenser 10. In various cases, before distribution to a patient, the chamber 108 of the housing 100 is filled with the flowable composition 1000 by injecting the flowable composition through the dispensing aperture 110 and into the chamber 108 between the plunger 200 and the first end 104 of the housing 100. In various cases, when the flowable composition 1000 is injected into the chamber 108, only the flowable composition 1000 is between the plunger 200 and the first end 104 of the housing 100. As illustrated in FIG. 22, in some cases, the flowable composition 1000 may initially cause the plunger 200 to "float" within the chamber 108 between the traveler 300 and the first end 104 of the housing 100. In some examples, the floating plunger 200 may reduce or limit the formation of air bubbles within the flowable composition as additional components that may cause bubble formation are reduced or eliminated within the chamber 108 between the plunger 200 and the first end 104.

As illustrated in FIG. 23, after the base 700 has been sufficiently rotated, which in turn rotates the drive screw 400 and axially moves the traveler 300, the traveler 300 engages the plunger 200, various cases, the plunger driver 314 engages the plunger 200 within the plunger cavity 208. In some examples, the end 316 of the plunger driver 314 engages the cavity end wall 212 of the plunger 200. In FIG. 24, the applicator 900 is attached to the first end 104 of the housing 100.

FIGS. 25-27 illustrate various non-limiting examples of applicators 900 having the applicator surface 904 with various profiles.

Figure 30:
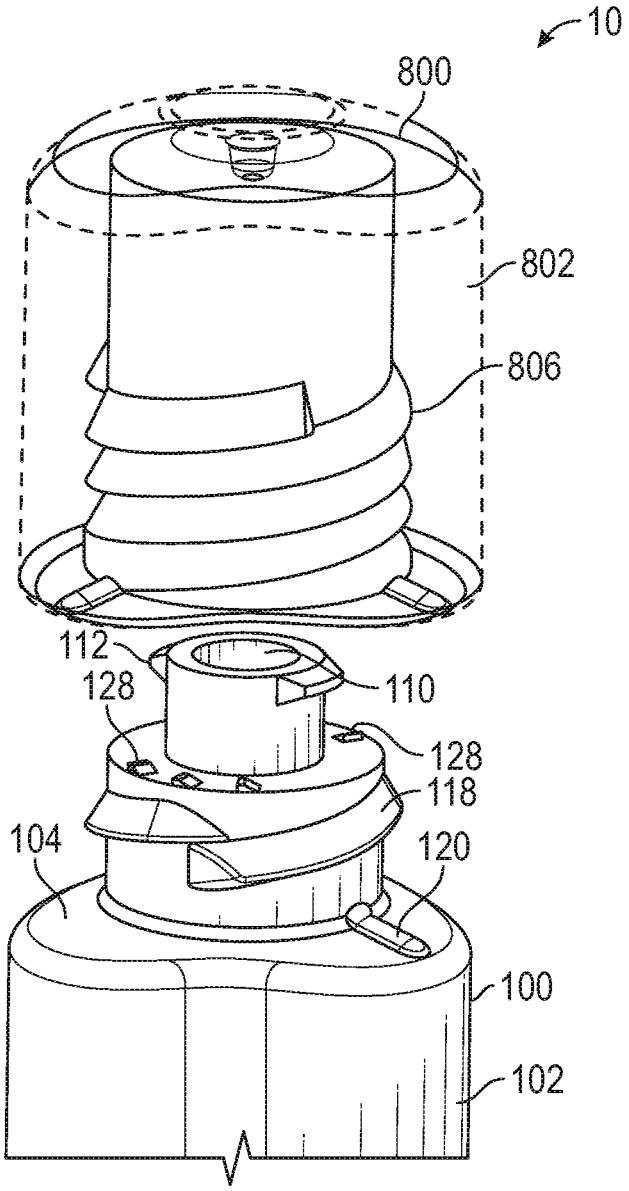
FIG. 30 is a perspective view of a portion of a dispenser including a cap and housing.
Figure 31:
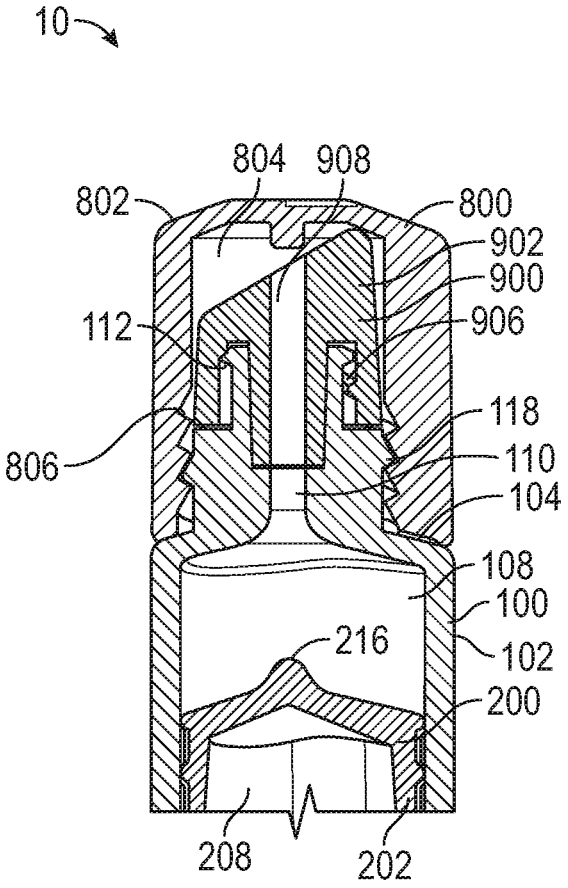
FIG. 31 is a detail sectional view of the dispensing end of FIG. 28 with an application tool and cap.

FIGS. 28-31 illustrate an example of the dispenser 10 where the locking interface 112 of the housing 100 is a male Luer-style surface and the locking interface 906 of the applicator 900 is a female Luer-style surface. As illustrated in FIG. 30, in some cases, the housing 100 includes ribs 128. The ribs 128 may provide a stopping interface with the locking interface 906, somewhat similar to the ribs 120. As illustrated in these figures, in some cases, the locking interface 112 may extend a certain distance above the threads 118, which may help reduce the amount of flowable composition that may get caught in the threads 118 during use.

Figure 32:
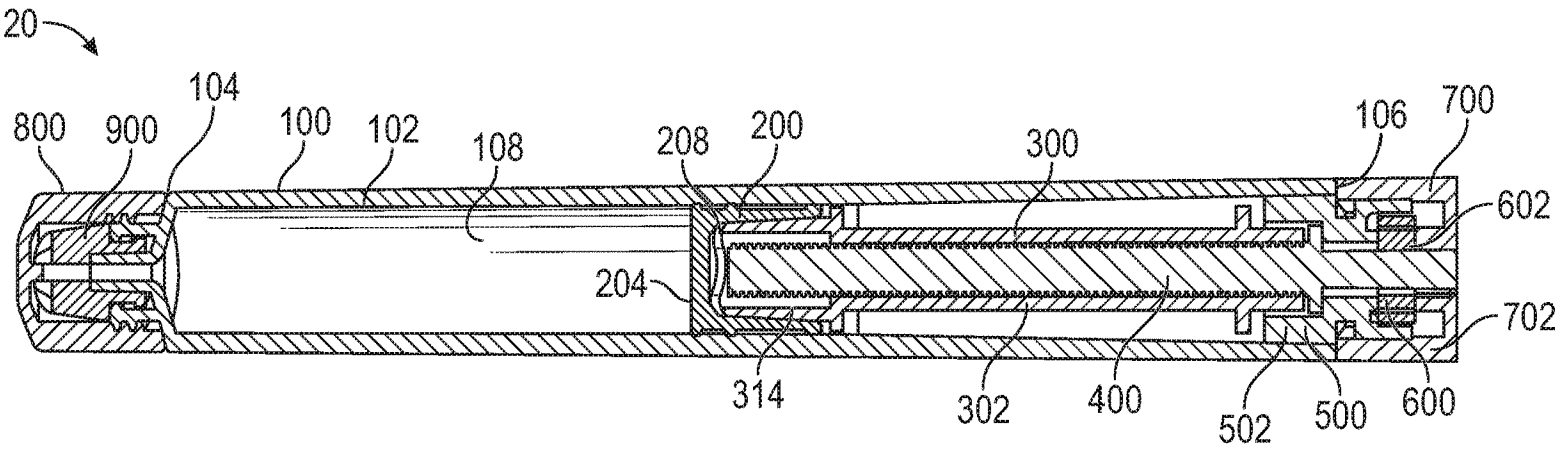
FIG. 32 is a sectional view of a portion of a dosing dispenser according to aspects of the present invention.
Figure 33:
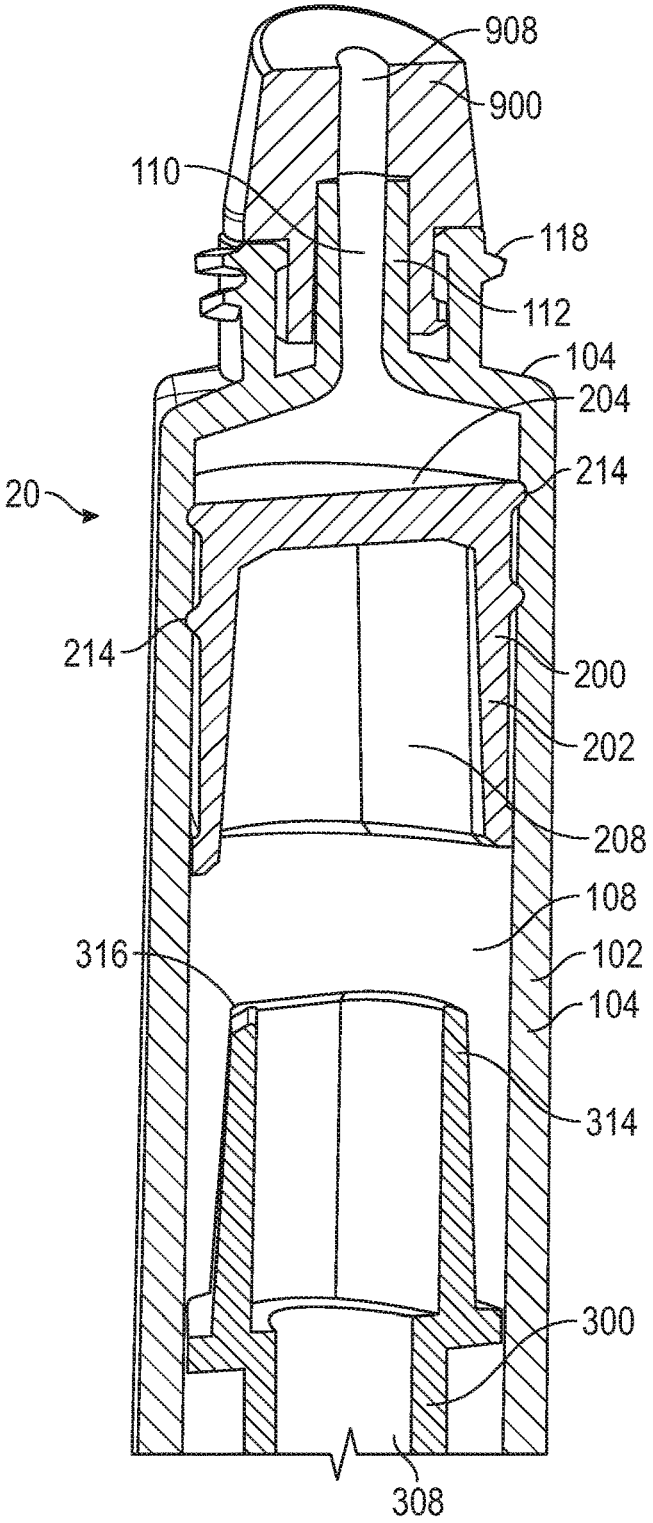
FIG. 33 is an enlarged sectional view of a portion of the dosing dispenser of FIG. 32.

FIGS. 32 and 33 illustrate an example of a dispenser 20 that is substantially similar to the dispenser 10 except that the first end 204 of the plunger 200 is flat and does not include the crown 216.

Figure 34:
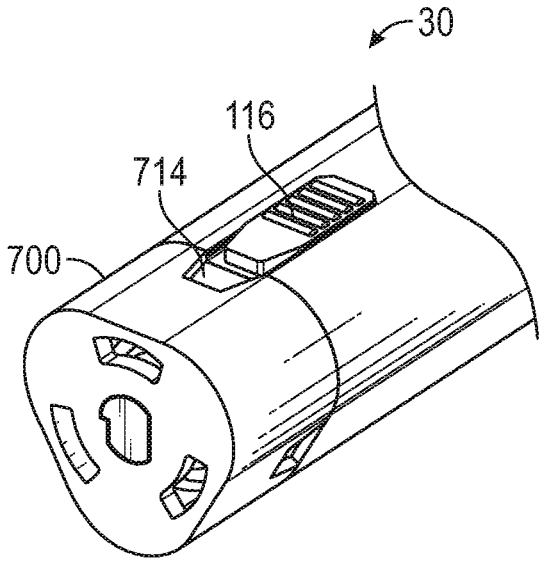
FIG. 34 is a perspective view a portion of a dosing dispenser with a lock tab in a disengaged configuration according to aspects of the present invention.
Figure 35:
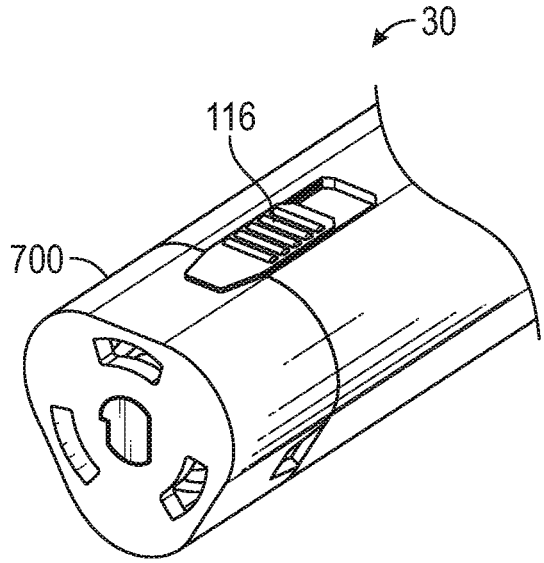
FIG. 35 is a perspective view of the portion of the dosing dispenser of FIG. 34 with the lock tab in an engaged configuration.

FIGS. 34 and 35 illustrate another example of a dispenser 30 that is substantially similar to the dispenser 10 except that the housing 100 of the dispenser 30 optionally includes a locking tab 116 at the second end 106 that is movable between an unlocked position (FIG. 34) and a locked position (FIG. 35). In various examples, the locking tab 116 may be manually movable relative to the housing 100 or mechanically movable relative to the housing 100, such as through springs, biasing members, etc. In these examples, the locking tab 116 is configured to engage a corresponding locking groove 714 on the base 700. In some cases, the locking tab 116 engages the locking groove 714 automatically after a single turn of the base 700, as described in detail below. In other examples, the locking tab 116 may engage the locking groove 714 as desired by the user. The locking tab 116 engaged with the locking groove 714 may prevent inadvertent rotation of the base 700. The locking tab 116 may also be provided for child-resistant operation of the dispenser 10.

Figure 36:
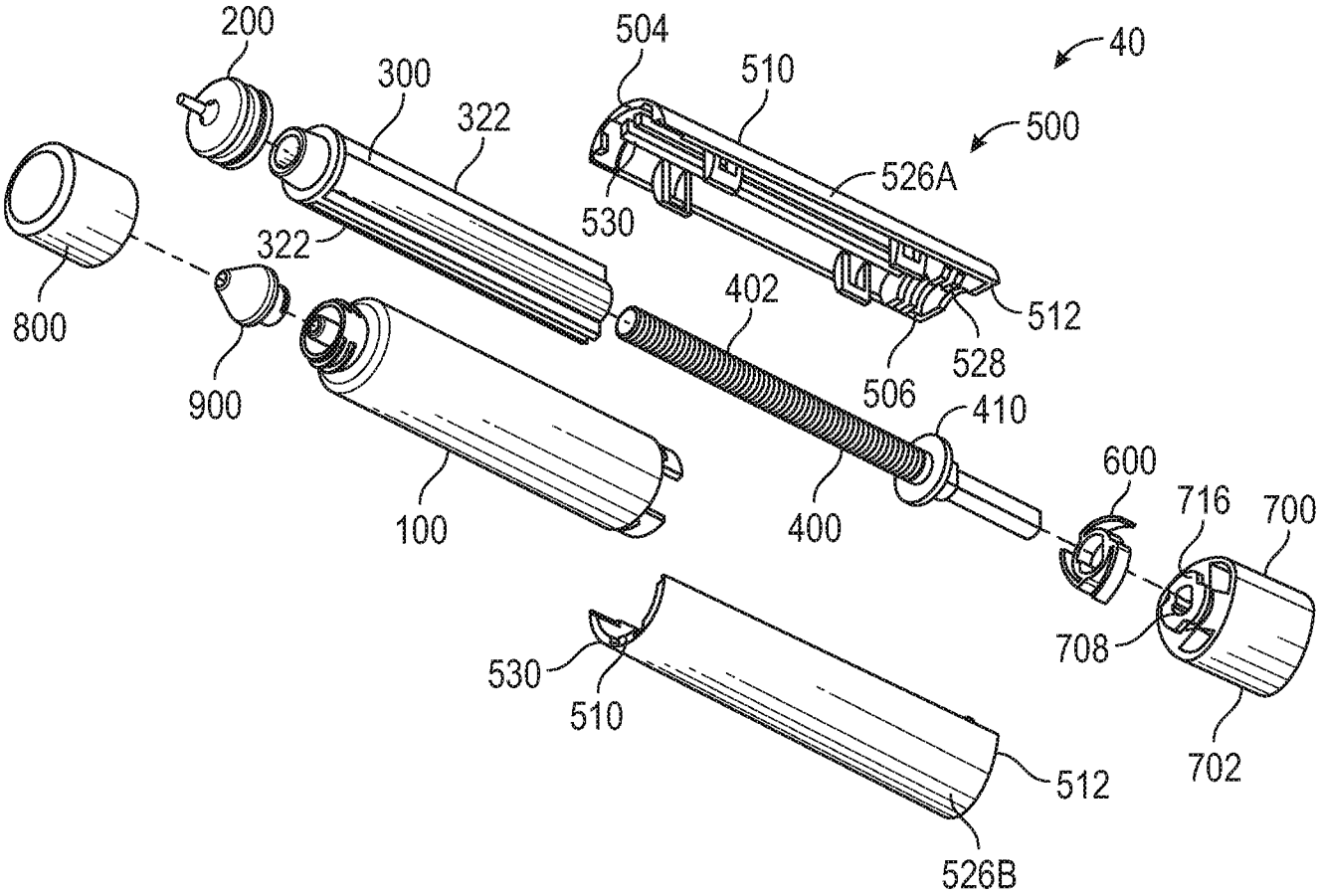
FIG. 36 is an exploded assembly view of a dosing dispenser according to aspects of the present invention.
Figure 37:
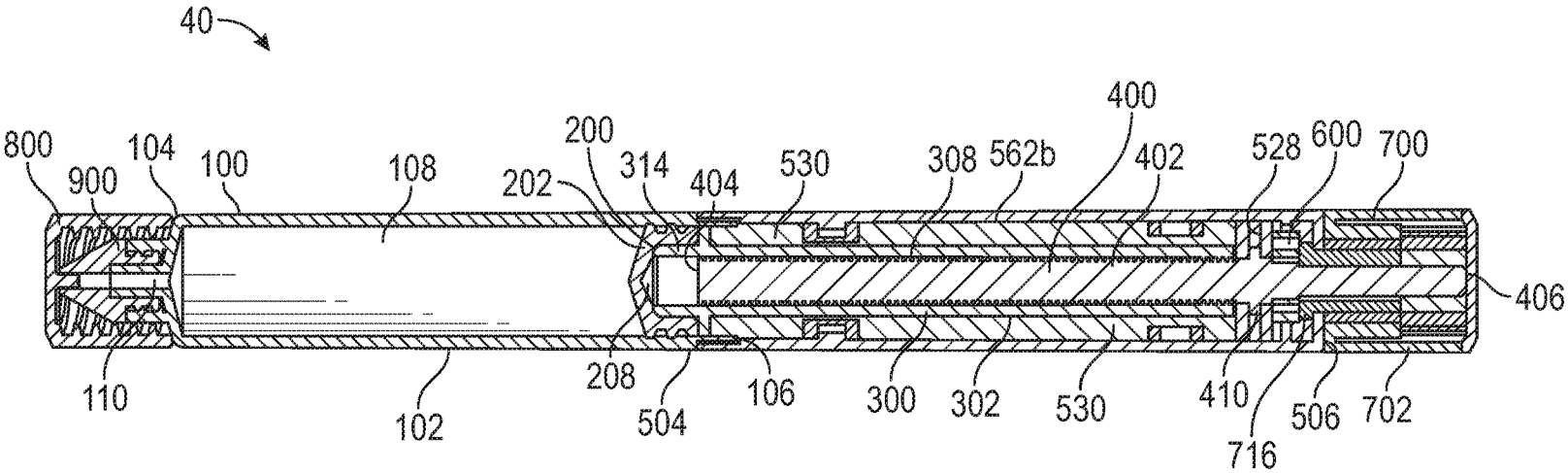
FIG. 37 is a sectional view of the dosing dispenser of FIG. 36.

FIGS. 36 and 37 illustrate an example of a dispenser 40 that is substantially similar to the dispenser 10 except that the traveler 300 and base support 500 are modified. In this example, the base support 500 includes two halves 526A-AB that are coupled to each other through snap-fitting or various other suitable attachment mechanisms. Each half 526A-B includes a locking groove 528 that is configured to retain the support collar 410 of the drive screw 400 when the halves 526A-B are assembled. The mounting portion 510 of each half includes a guide 530. The guides 530 are configured to engage projections 322 provided along the body 302 of the traveler 300 to prevent rotation of the traveler 300 as the traveler 300 is axially positioned along the drive screw 400. In this example, the cross-sectional shape of the assembled base support 500 is different that the cross sectional shape of the housing 100. Optionally, the base support 500 and housing 100 of the dispenser 40have a circular shape, although they need not.

In addition, in this example, the base support 500 is coupled to the housing 100 in a snap-fit configuration such that a portion of the base support 500 overlaps a portion of the housing 100. For example, the second end 106 of the housing 100 is within the mounting portion cavity 516 of the base support 500. In various cases, the base 700 includes a base projection 716 that is insertable into the supporting portion cavity 520 of the base support such that the base 700 is rotatably supported by the base support 500.

Figure 38:
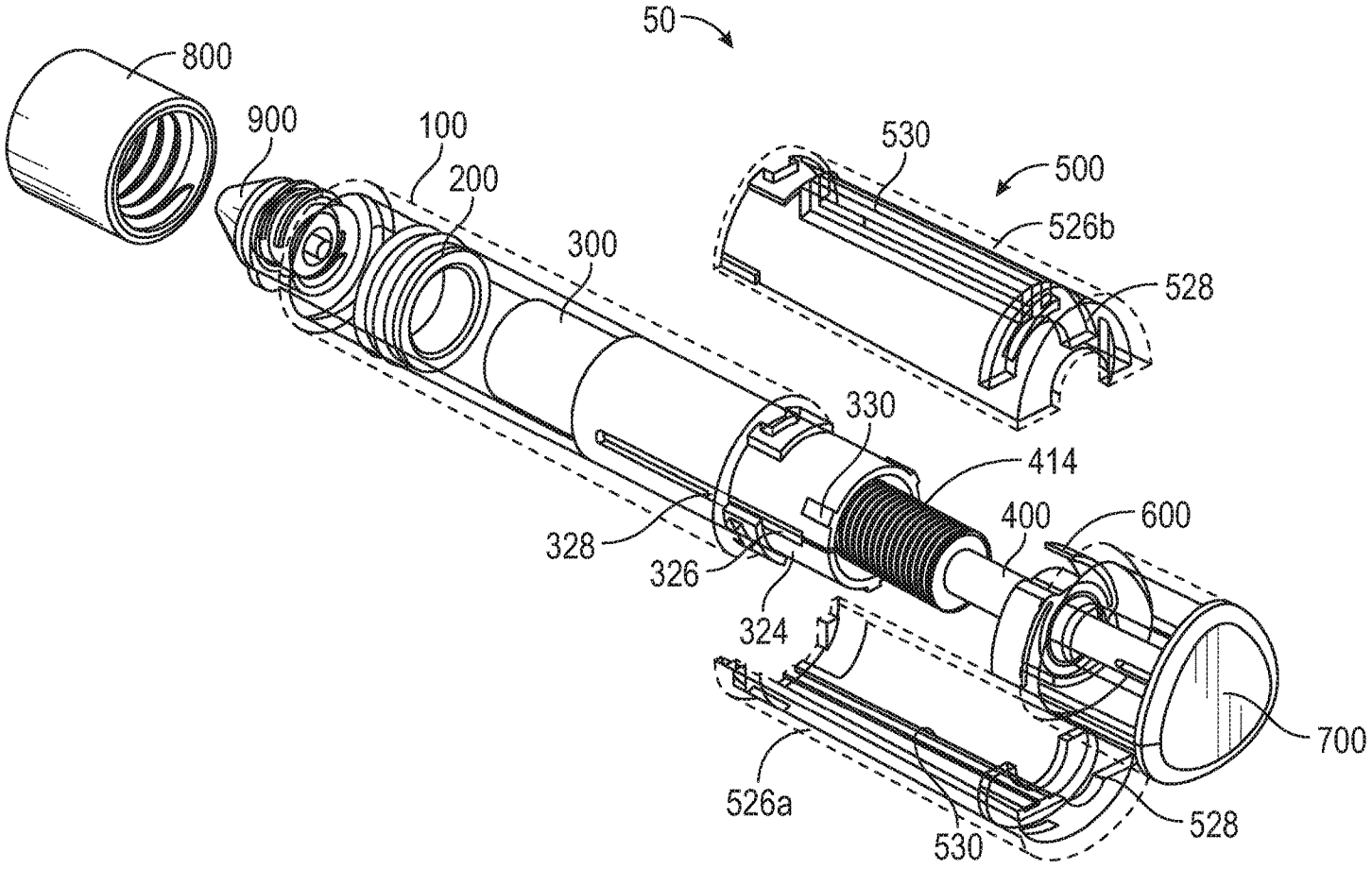
FIG. 38 is an exploded assembly view of a dosing dispenser according to aspects of the present invention.
Figure 39:
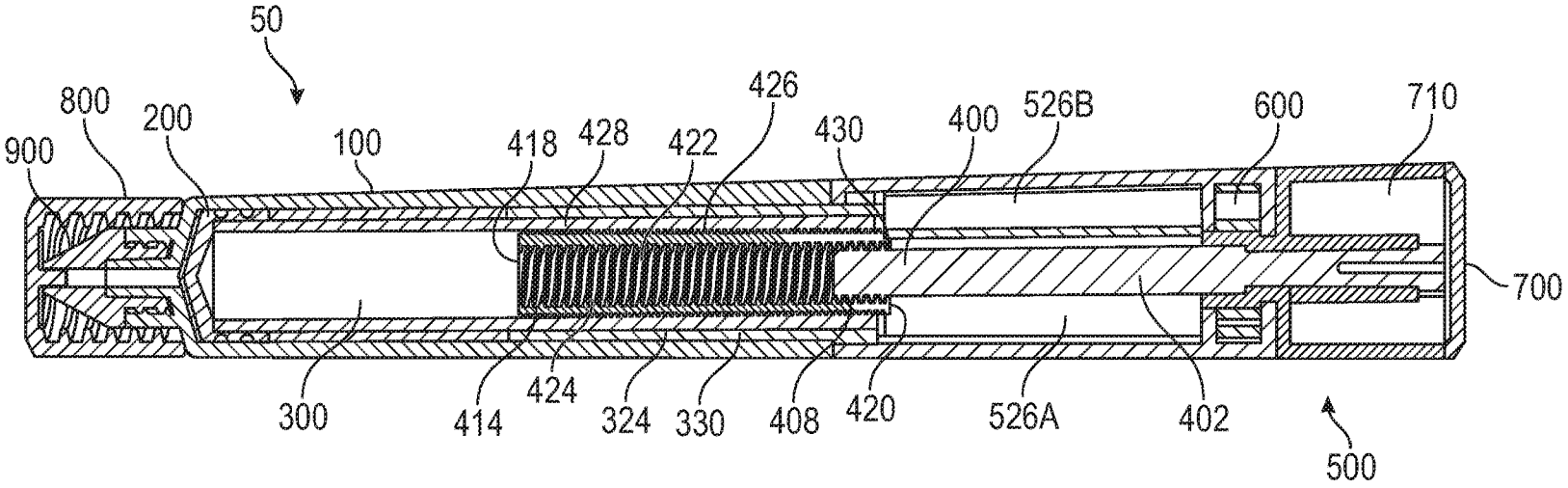
FIG. 39 is a sectional view of the dosing dispenser of FIG. 38.

FIGS. 38 and 39 illustrate an example of a dispenser 50 that is substantially similar to the dispenser 40 except that the drive screw 400 includes an intermediate drive screw 414. As illustrated, in this example, the intermediate drive screw 414 includes a body 416 having a first end 418 and a second end 420. The body 416 defines a central channel 422 that extends from the first end 418 to the second end 420. Threads 424 are provided along the central channel 422 and are configured to engage with the threading 408 of the drive screw 400. As illustrated in FIG. 39, in some cases, the threads 408 of the drive screw 400 may only be provided along a portion of the body 402. Threads 426 are provided along the outer surface of the body 416 and are configured to engage with the threads 310 of the traveler 300. In some cases, a first stopper 428 may be provided on the outer surface proximate to the first end 418 to prevent disengagement of the traveler 300 from the intermediate drive screw 414. In a similar manner, a second stopper 430 may be provided within the central channel 422 proximate to the second end 420 to prevent disengagement of the intermediate drive screw 414 from the drive screw 400. In various examples, this screw within a screw arrangement of the traveler 300, intermediate drive screw 414, and drive screw 400 may be used to reduce an overall length of the dispenser 50.

As illustrated in FIGS. 38 and 39, the traveler 300also includes a traveler cover 324. The traveler cover 324 includes at least one slot 326 that may be used as a guide for projections 328 of the traveler 300. The traveler cover 324 may also include projections 330 that are configured to engage with the housing 100 or the base support 500 to reduce or restrict rotation of the traveler 300 and traveler cover 324 during use.

Figure 40:
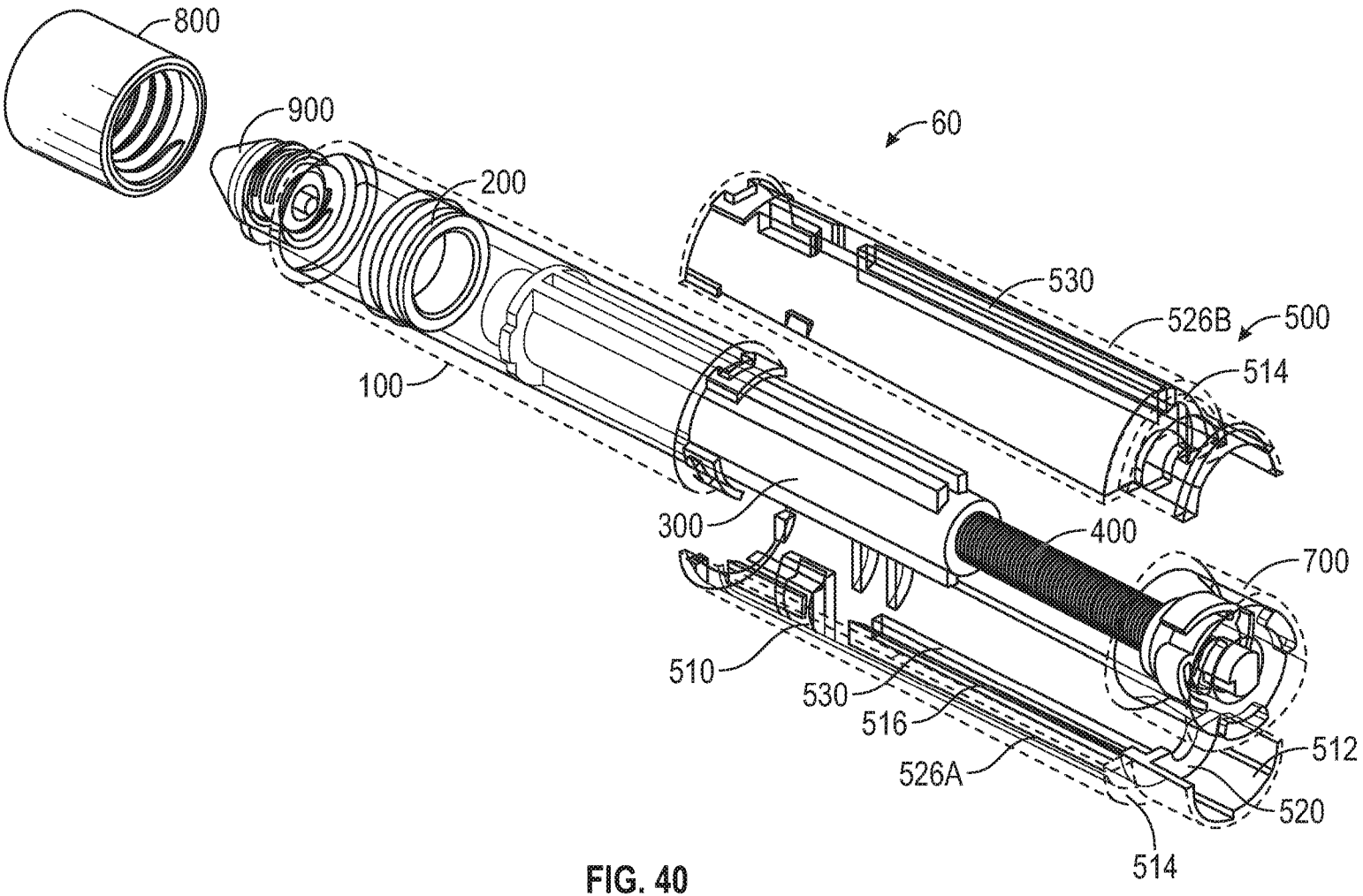
FIG. 40 an exploded assembly view of a dosing dispenser according to aspects of the present invention.
Figure 41:
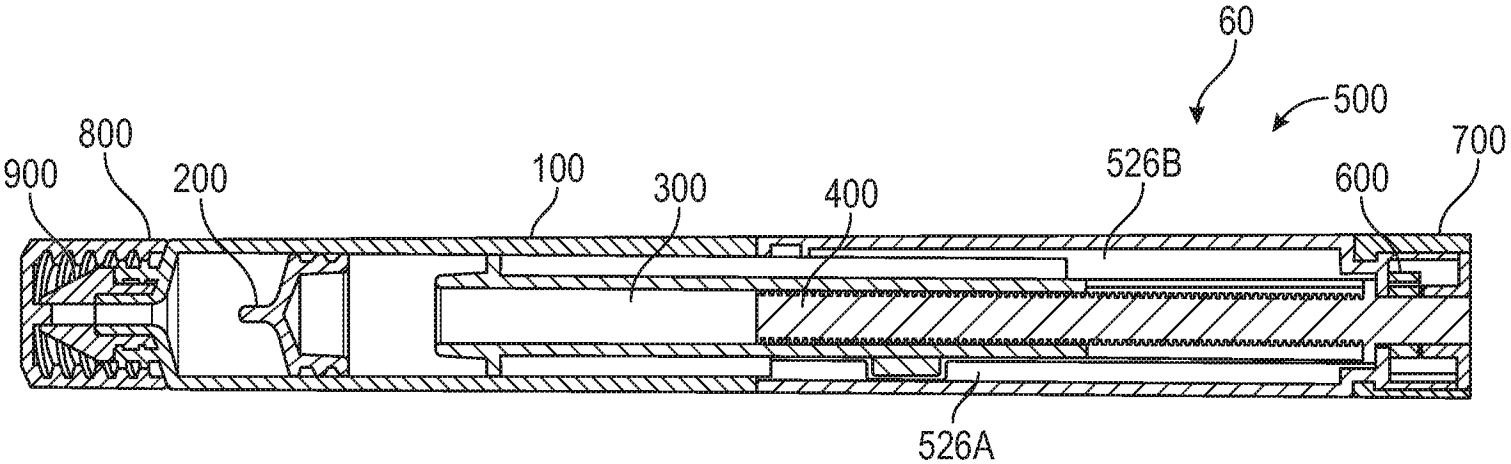
FIG. 41 is a sectional view of the dosing dispenser of FIG. 40.

FIGS. 40 and 41 illustrate an example of a dispenser 60 that is substantially similar to the dispenser 40 except that the halves 526A-B define the attachment groove 514. Similar to the dispenser 10, in this example, the base 700 attaches to the base support 500 by engaging the attachment groove 514 such that at least a portion of the base support 500 is within the base cavity 710. In this example, the dispenser 60 may function as a syringe when the halves 526A-B are omitted.

Figure 42:
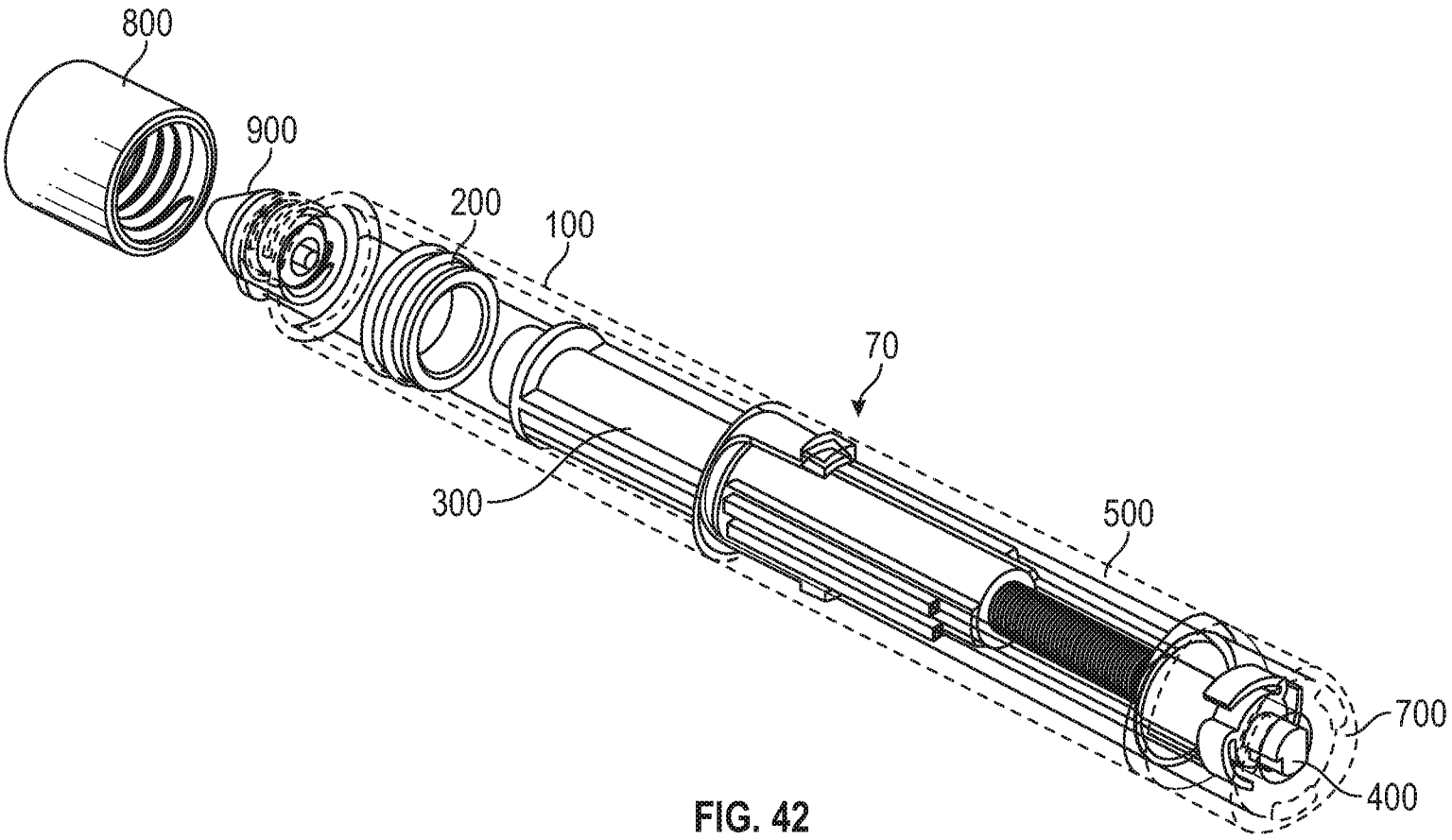
FIG. 42 is a partially exploded assembly view of a dosing dispenser according to aspects of the present invention.
Figure 43:
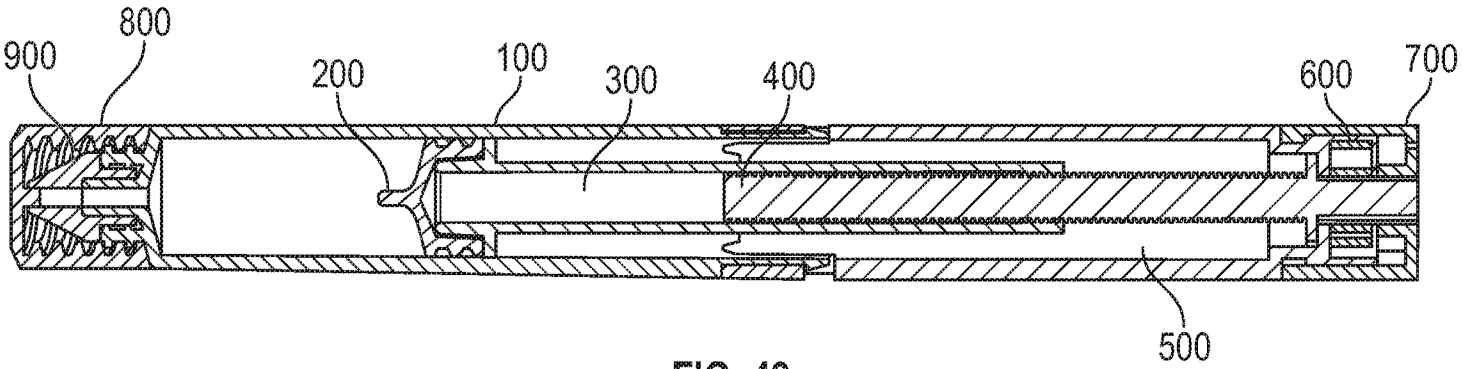
FIG. 43 is a sectional view of the dosing dispenser of FIG. 42.

FIGS. 42 and 43 illustrate an example of a dispenser 70 that is similar to the dispenser 60 except that the base support 500 is a unitary piece rather than having the two halves 526A-B that are detachably connected.

Figure 44:
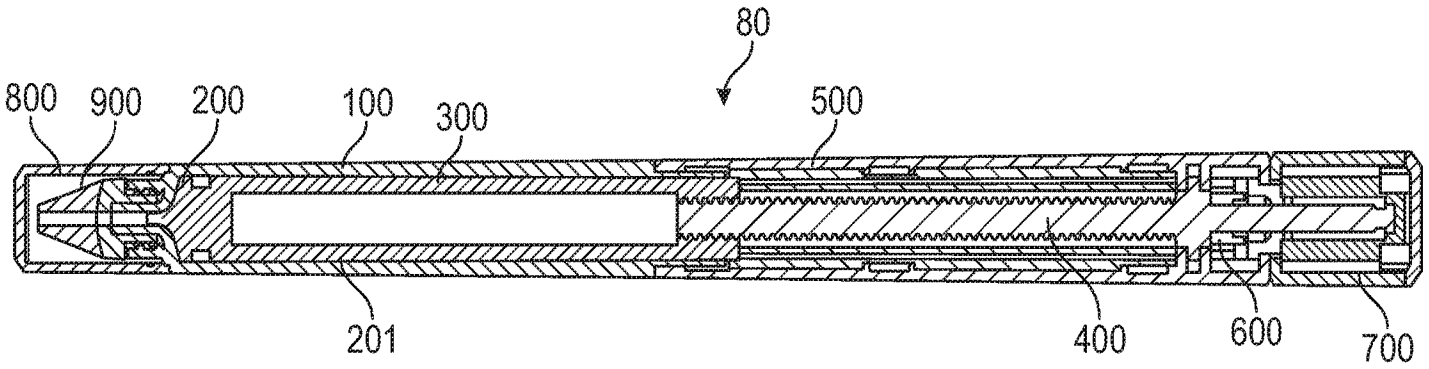
FIG. 44 is a sectional view of a dosing dispenser according to aspects of the present invention.
Figure 45:
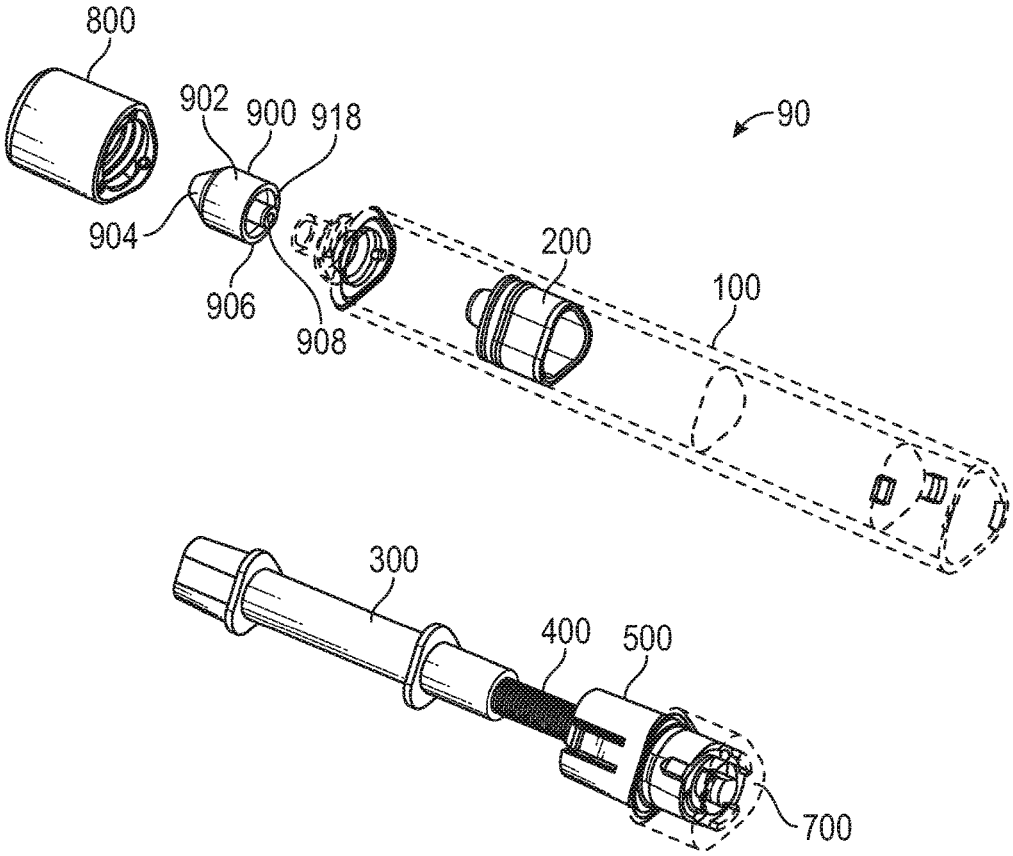
FIG. 45 is an exploded assembly view of a dosing dispenser according to aspects of the present invention.
Figure 46:
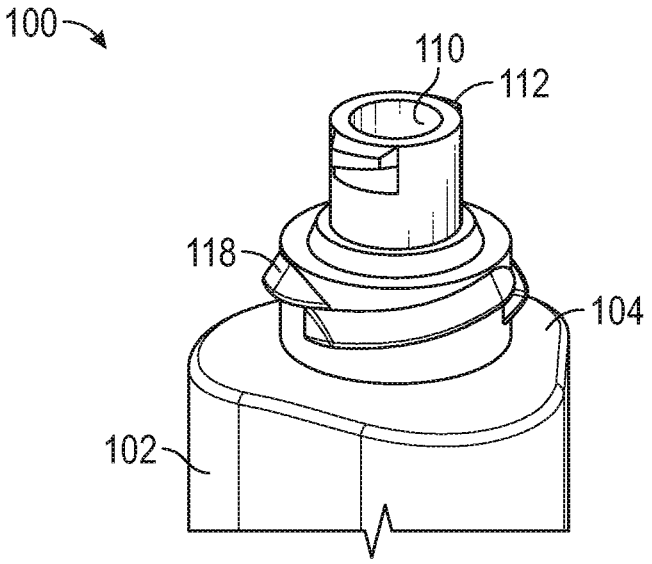
FIG. 46 is a perspective view of a portion of the dosing dispenser of FIG. 45.

FIG. 44 illustrates another example of a dispenser 80 in which the traveler 300 and plunger 200 are integrally formed as a single component 201. The housing 100, base support 500 and/or base 700 may he similar to that of any of the dispensers described previously.

FIGS. 45-49 illustrate an example of a dispenser 90 that is substantially similar to the dispenser 10 except that the locking interface 112 of the housing 100 is a female Luer-style surface and the locking interface 906 of the applicator 900 is a male Luer-style surface. In some examples, the female Luer-style locking interface 112 may allow for direct attachment of the dispenser 90 to various Luer-lock syringes on the market for filling without an adapter.

Figure 47:
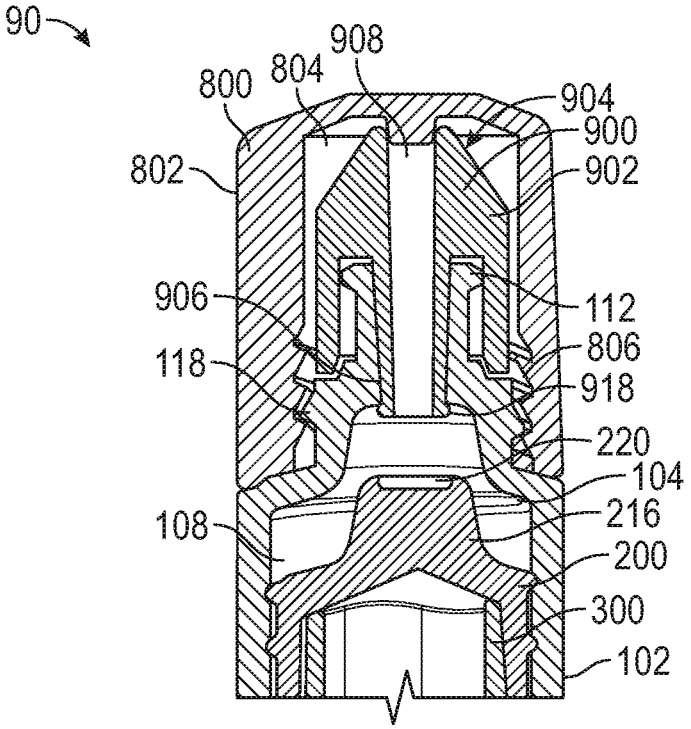
FIG. 47 is an enlarged sectional view of a portion of the dosing dispenser of FIG. 45 including a housing, plunger, applicator tool, and cap.
Figure 48:
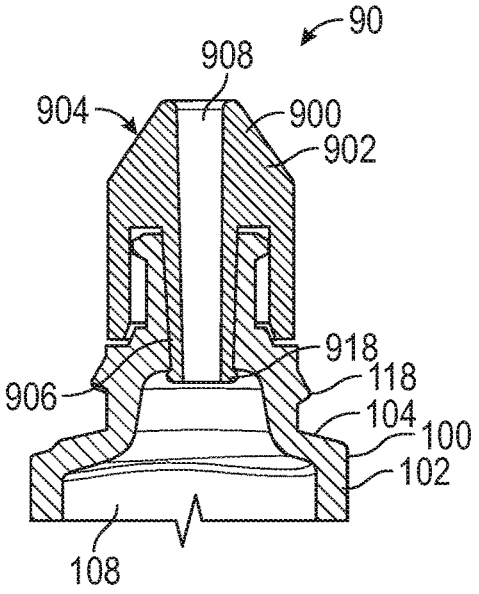
FIG. 48 is an enlarged sectional view of a portion of the dosing dispenser 45 including a housing and applicator tool.
Figure 49:
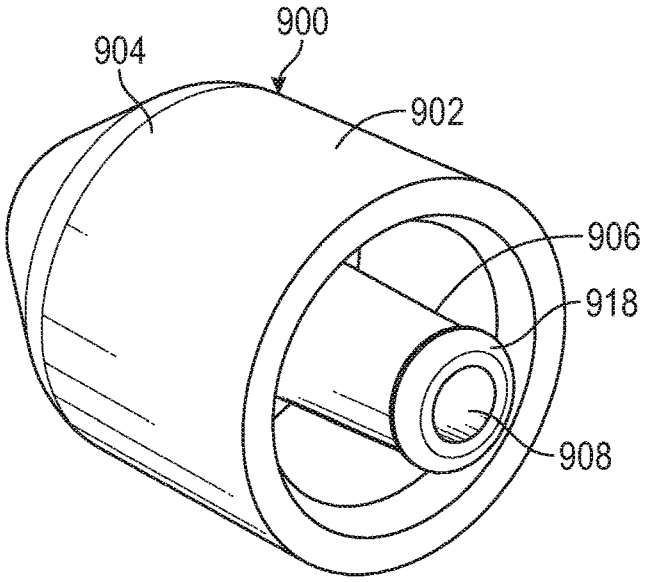
FIG. 49 is a perspective view of an applicator tool of the dosing dispenser of FIG. 45.

In various examples, as illustrated in FIGS. 45 and 47-49, the housing locking interface 906 includes an engagement collar 918 that is configured to snap-fit onto the housing 100 within the chamber 108 (see, e.g., FIG. 47). The snap-fit engagement between the applicator 900 and the housing 100 through the engagement collar 918 may provide a more consistent and/or tight gap between the housing 100 and the applicator 900. In some examples, the snap-fit engagement through the engagement collar 918 may limit or prevent removal of the applicator 900 from the housing 100.

As illustrated in FIG. 47, in some examples where the applicator 900 includes the engagement collar 918, the crown 216 of the plunger 200 optionally includes an applicator recess 220 that is dimensioned to accommodate the engagement collar 918 when the plunger 200 abuts the first end 104 of the housing 100 within the chamber 108. In these examples, the crown 216 may or may not be insertable within the dispensing channel 908. In other examples, the applicator recess 220 is omitted from the plunger 200. The size and shape of the applicator recess 220 should not be considered limiting on the current disclosure.

Figure 50:
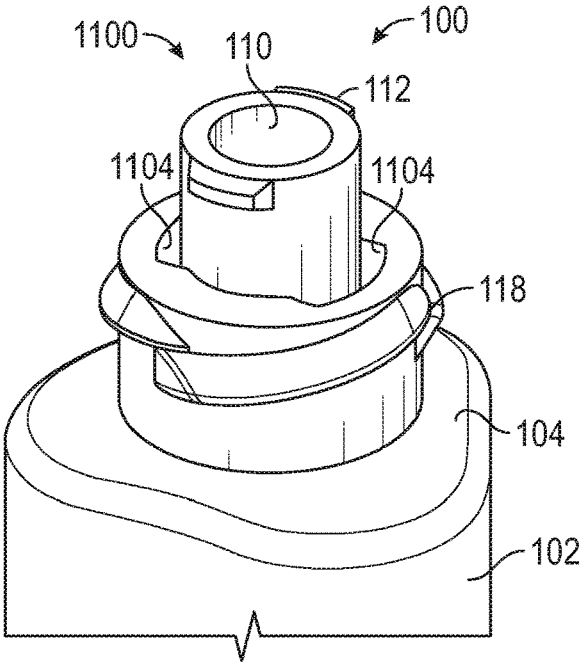
FIG. 50 is a perspective view of a portion of a dosing dispenser according to aspects of the present disclosure.
Figure 51:
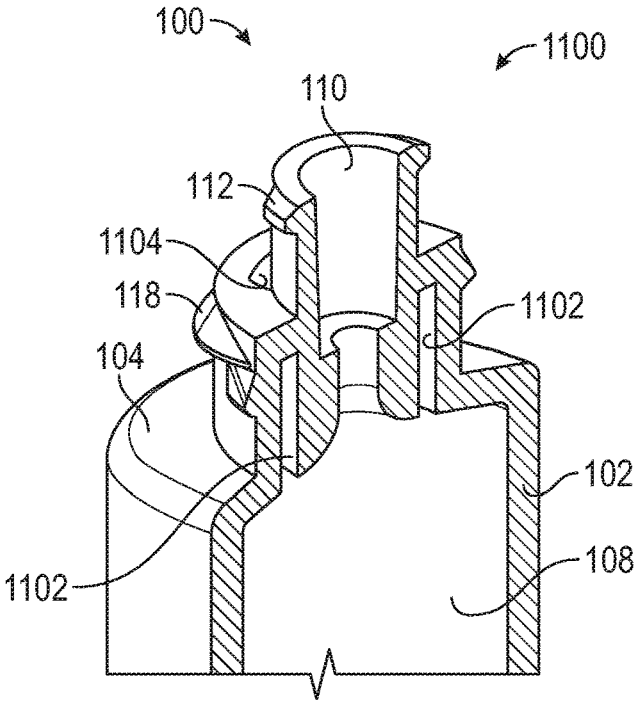
FIG. 51 is a perspective sectional view of the portion of the dosing dispenser of FIG. 50.
Figure 52:
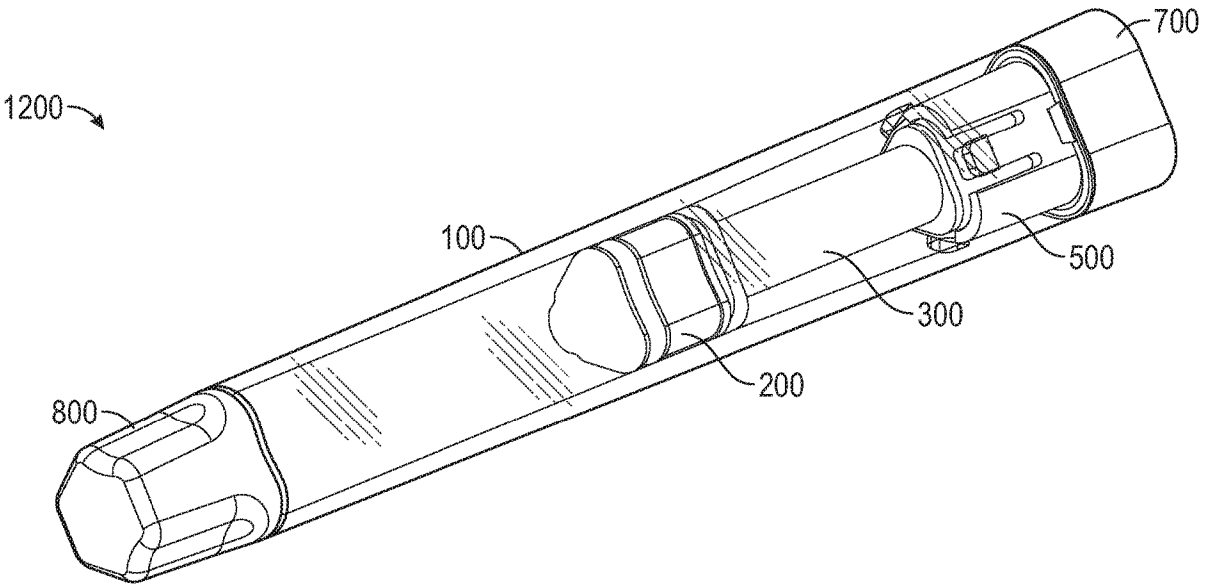
FIG. 52 is a perspective view of a dosing dispenser according to aspects of the present invention.
Figure 53:
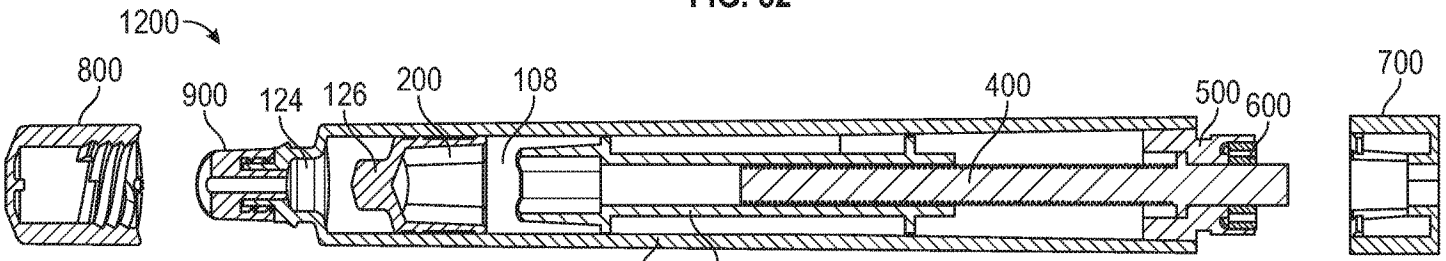
FIG. 53 is a sectional view of the dosing dispenser of FIG. 52.

FIGS. 50 and 51 illustrate an example of a dispenser 1100 that is substantially similar to the dispenser 10 except that the locking interface 112 of the housing 100 is a female Luer-style surface that further includes internal cored sections 1102 and external cored sections 1104. In certain examples, the cored sections 1102 and 1104 may reduce thick sections of the housing 100 that may otherwise be present, and therefore reduce the weight of the dispenser 1100. In certain cases, the cored sections 1102 and 1104 alternate around a perimeter of the dispensing aperture 110, although they need not. As illustrated in FIGS. 50 and 51, in various examples, the internal cored sections 1102 are offset from the external cored sections 1104, which may allow for thickness reduction of the housing 100 while maintaining the chamber 108.

Figure 54:
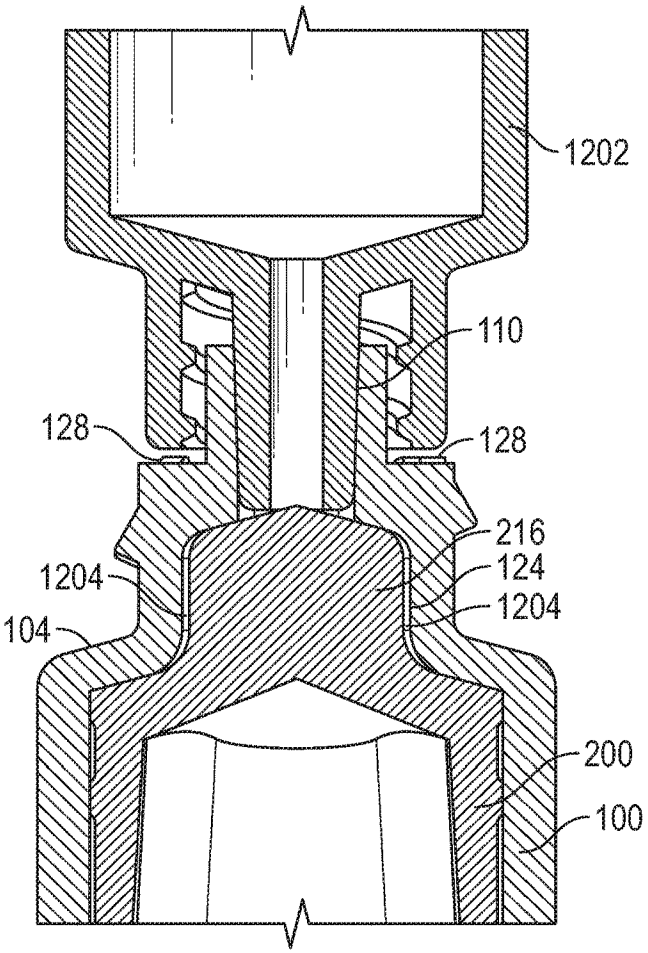
FIG. 54 is a sectional view of a portion of the dosing dispenser of FIG. 52 engaged with a refilling device.
Figure 56:
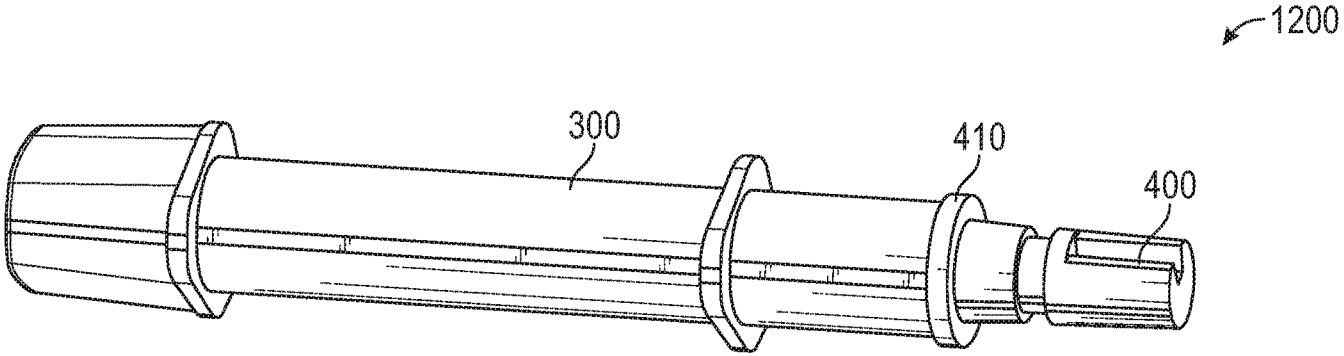
FIG. 56 is a perspective view of a traveler and drive screw of the dosing dispenser of FIG. 52.
Figure 57:
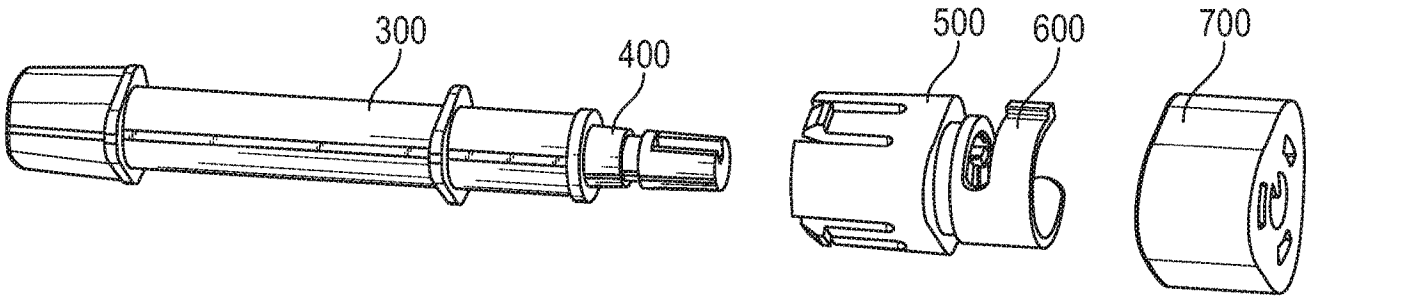
FIG. 57 is a perspective view of the traveler, drive screw, base support, cam, and base of the dosing dispenser of FIG. 52.
Figure 58:
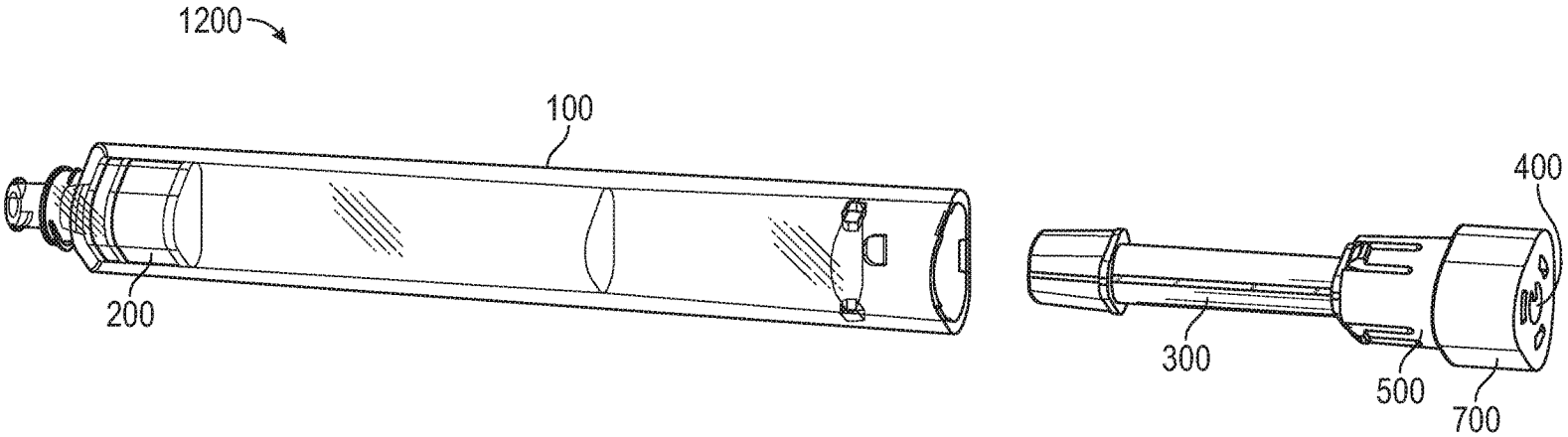
FIG. 58 is a perspective view of the traveler, housing, plunger, drive screw, base support, cam, and base of the dosing dispenser of FIG. 52.
Figure 59:
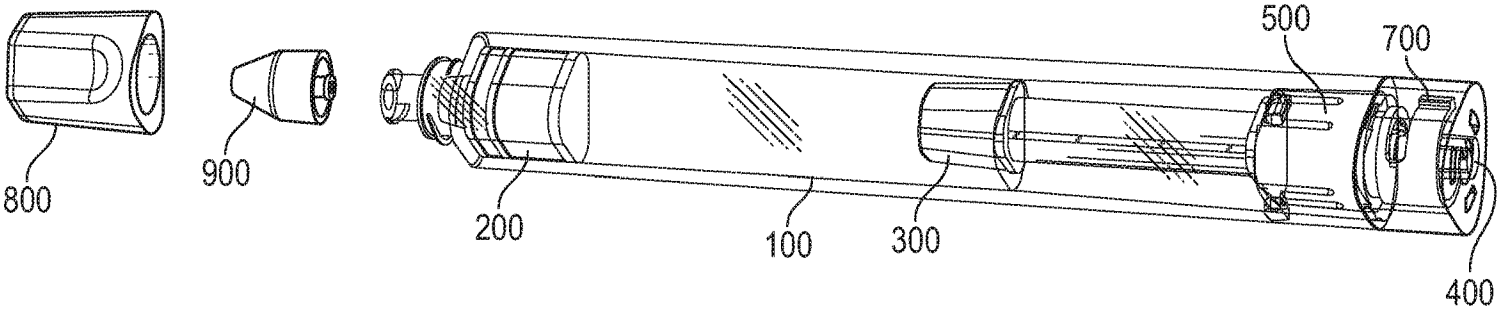
FIG. 59 is a perspective view of the traveler, housing, applicator tool, cap, plunger, drive screw, base support, can, and base of the dosing dispenser of FIG. 52

FIGS. 52-59 illustrate an example of a dispenser 1200 that is substantially similar to the dispenser 10 except that the crown 216 of the plunger 200 is modified and the housing 100 defines an intermediate chamber 124 between the chamber 108 and the dispensing aperture 110. In certain examples, as illustrated in FIG. 54, the crown 216 may partially extend into the dispensing aperture 110 and/or the intermediate chamber 124 before the chamber 108 is filled with the flowable composition, at various positions or dosages while or after the flowable composition is being dispensed, or both.

As illustrated in FIG. 54, in some examples, the crown 216 optionally may engage a refilling device 1202 (e.g., a filling syringe) during filling of the dispenser 1200 with the flowable composition, although it need not. Optionally, air gaps 1204 are defined in the intermediate chamber 124 when the plunger 200 is in the intermediate chamber 124. In other examples, the air gaps 1204 may be omitted.

Figure 55:
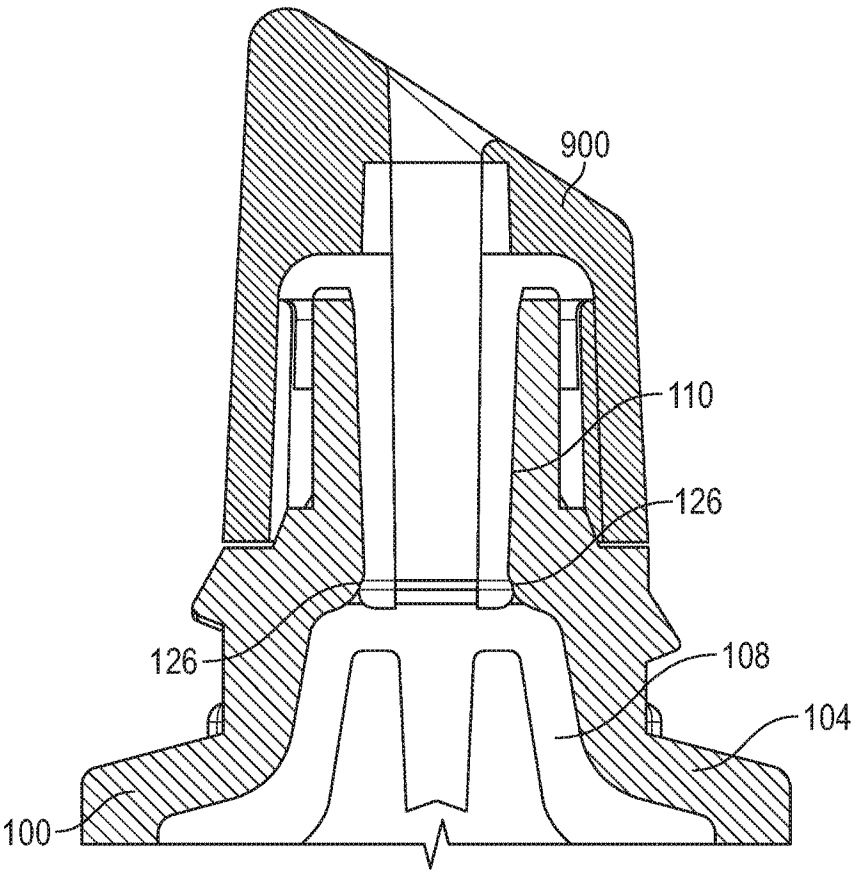
FIG. 55 is a sectional view of a portion of the dosing dispenser of FIG. 52.

In various examples, as illustrated in FIG. 55, the housing 100 also includes a locking tab 126 or other similar mechanism in or proximate to the dispensing aperture 110. As illustrated in FIG. 55, the locking tab 126 may facilitate engagement and securing the applicator 900 on the housing 100 (and optionally within the dispensing aperture 110.

FIGS. 56-59 illustrate a non-limiting example of steps for assembly the dispenser 1200. In some examples, in a first step, the traveler 300 is run all the way up the drive screw 400 (see FIG. 56). Optionally, the traveler 300 is run up the drive screw 400 such that the traveler abuts the support collar 410. In various examples, in a second step, the base support 500, cam 600, and base 700 are assembled and secured onto the drive screw 400 (see FIG. 57). Optionally, in a third step the plunger 200 is positioned within the chamber 108 of the housing 100. In some examples, the plunger 200 is inserted such that the plunger is at least partially positioned within the intermediate chamber 124 (see FIG. 58). After the plunger 200 is positioned within the chamber 108, the assembled traveler 300, drive screw 400, base support 500, cam 600, and base 700 are assembled with the housing 100 such that the traveler 300 is movable within the chamber 108 (see FIG. 59).

In general, once the dispenser 10 (or any of the dispensers 20, 30, 40, 50, 60, 70, 80, 90, 1100, or 1200) is assembled but prior to coupling of the applicator 900, the chamber 108 is filled with the appropriate measured amount of flowable composition. The base 700 is turned so that the drive screw 400 turns and advances the plunger 200 and flowable composition toward the first end 104 of the housing 100. The applicator 900 is then snapped onto the first end 104 of housing 100. The base 700 is turned and the plunger 200 is advanced until there is essentially no air inside the chamber 108 between the flowable composition and the applicator 900. The cap 800 is placed on the applicator 900 and the dispenser 10 is ready for use.

The user removes the cap 800 and turns the base 700 the appropriate amount of clicks (typically as directed on the instructions given to the user by the dispensing physician or pharmacy). As the base 700 is turned, the arms 606 of the cam 600 flex and move over the cam 600 as described above, and/or at least projection 610 moves toward at least one of the slots 522. As the projection 610 passes over and into the slot 522, at least one audible "click" is heard when the base 700 reaches a home or "click" position. Also, the user may sense a vibration when the base 700 reaches a home or "click" position.

With each click, a predetermined amount of flowable composition 1000 is forced by the rising plunger 200 to be dispensed through the applicator 900. In the embodiments where the flowable composition 1000 is an emulsion, cream, or other semi-solid composition, the dispensed flowable composition 1000 may form a bead or pool over the central area of the applicator surface 904 of the applicator 900. The user applies the flowable composition 1000 to the skin by rubbing the applicator 900 on the skin. The flowable composition 1000 at least partially spreads out over the applicator surface 904 and is rubbed into the skin.

The tactile and audible click heard as the base 700 is rotated provides feedback as to how much flowable composition 1000 is dispensed. For example, the prescription might be for 1 cc of flowable composition 1000 per dose to be applied to the skin. If each click is 0.25 cc, for example, then the prescription might instruct the user to turn the base 700 to hear four clicks so as to dispense 1 cc of flowable composition 1000. The design of the present invention substantially prevents reverse rotation of the base 700 with respect to the housing 100 so that flowable composition 1000 is not inadvertently sucked back into the dispenser 10, which may reduce the effective dosage dispensed and may contaminate the flowable composition 1000 in the chamber 108. The click also provides positive feedback when the right amount of flowable composition 1000 has been dispensed per turn. In various cases, the amount of flowable composition 1000 dispensed per click may be adjusted or varied by changing the distance or amount of rotation of the base 700 between clicks. In some cases, changing the amount of rotation of the base 700 between clicks may include changing the size, number, or shape of the slots 522 of the base support 500, changing the threads 408 on the drive screw 400, and/or changing the size, number, or shape of the arms 606 of the cam 600, among others.

In certain embodiments, the dispenser 10 of the present invention may optionally include a vibration mechanism whereby the dispenser 10 and, in particular, the applicator 900 area vibrates when activated so as to improve transfer of the flowable composition 1000 to the skin. The vibration mechanism may be one of several possible mechanisms known to those skilled in the art.

The dispenser of the present invention may also include an indicator mechanism either to show the approximate number of remaining doses or to show when the chamber 108 is near empty, both so that the user can have advance awareness that a refill may be needed.

In certain embodiments, the indicator may be a visual indicator, such as ruler with a set of marks along the side of the housing 100, with each mark being correlated to a particular quantity of flowable composition 1000 remaining in the dispenser 10. In these embodiments, the housing 100, or at least a portion thereof (such as an elongated window extending from near the first end 104 to near the second end 106) may be clear or translucent. As one non-limiting example, FIG. 18 illustrates the dispenser with a visual indicator 101 wherein the visual indicator 101 includes at least one mark. In certain examples, the visual indicator 101 may provide a visual indication for home or "click" positions. In other examples, the visual indicator 101 may be through a shape of components, such as the shape of the base 700 and the shape of the body 102. In one non-limiting example, the dispenser 10 provides a visual indication of the home or "click" positions when the shape or outline of the base 700 aligns with the shape or outline of the body 102 as the base 700 is rotated relative to the body 102. For example, both the body 102 and the base 700 may be triangular shaped, and a home or "click" position is visually indicated when the corners of the base 700 align with the corners of the body 102. Various other visual indicators may be provided for providing visual indication of the home or "click positions," including, but not limited to, aligning components, marks, dots, stripes, colors, etc.

In that various components may be reused in different capacities. For example, in one aspect, the volume is modular so that different housings 100 having chambers 108 with different volumes may be interchanged while using the same plunger 200, base support 500, cam 600 base 700, cap 800, and applicator 900. In some cases, the same traveler 300 and drive screw 400 may be used with the different sized housing 100, or the size of the traveler 300 and drive screw 400 may be adjusted depending on the size of the chamber 108.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive, and the invention is not limited to these example embodiments but rather encompasses all possible modifications and variations within the scope of the issued claims and their equivalents.

EC 1. A dosing dispenser including: a housing having a first end and a second end, the housing defining a chamber extending from the first end to the second end, the first end of the housing including a dispensing channel in fluid communication with the chamber; a plunger including a first end and a second end, the plunger positionable within the chamber with the first end proximate to the first end of the housing and the second end proximate to the second end of the housing, the second end of the plunger defining a plunger cavity, the plunger defining a filling portion of the chamber between the first end of the housing and the first end of the plunger; and a traveler including a first end and a second end, the traveler positionable within the chamber, the first end including a plunger driver configured to selectively engage the plunger within the plunger cavity and movably position the plunger within the chamber.

EC 2. The dosing dispenser of any of the preceding or subsequent example combinations, further including a base assembly coupled to the second end of the housing, the base assembly including a base and configured to movably position the traveler within the chamber through rotation of the base.

EC 3. The dosing dispenser of any of the preceding or subsequent example combinations, wherein the base assembly further includes: a drive screw threadably engaged with the traveler and coupled to the base such that rotation of the base rotates the drive screw and axially moves the traveler within the chamber; a base support rotatably supporting the drive screw and the base, the base support including a mounting portion and a supporting portion, the supporting portion including at least one notch; and a cam mounted on the drive screw and including at least one extension configured to engage the at least one notch as the cam is rotated through the drive screw.

EC 4. The dosing dispenser of any of the preceding or subsequent example combinations, wherein the drive screw includes a first end, a second end, and a support collar between the first end and the second end, wherein the drive screw includes external threads between the first end and the support collar configured to threadably engage the traveler, and wherein the base support axially retains the drive screw relative to the base support through engagement of the base support with the support collar of the drive screw.

EC 5. The dosing dispenser of any of the preceding or subsequent example combinations, wherein the traveler is movable between an engaged position and a disengaged position relative to the plunger; wherein in the disengaged position, the traveler is spaced apart from the plunger, and wherein in the engaged position, the plunger driver of the traveler abuts the plunger within the plunger cavity.

EC 6. The dosing dispenser of any of the preceding or subsequent example combinations, wherein a cross-sectional shape of the plunger is substantially similar to a cross-sectional shape of the chamber such that the plunger forms a fluid tight seal with the housing within the chamber as the plunger is movably positioned within the chamber.

EC 7. The dosing dispenser of any of the preceding or subsequent example combinations, wherein the first end of the plunger includes a crown, and wherein at least a portion of the crown is positionable within the dispensing channel of the housing when a volume of the filling portion of the chamber is at a minimum.

EC 8. A dosing dispenser including: a housing having a first end and a second end, the housing defining a chamber extending from the first end to the second end, the first end of the housing including a dispensing channel in fluid communication with the chamber; a plunger including a first end and a second end, the plunger positionable within the chamber with the first end proximate to the first end of the housing and the second end proximate to the second end of the housing, the second end of the plunger defining a plunger cavity, the plunger defining a filling portion of the chamber between the first end of the housing and the first end of the plunger; and a base assembly coupled to the second end of the housing, the base assembly including a base and configured to movably position the plunger within the chamber through rotation of the base.

EC 9. The dosing dispenser of any of the preceding or subsequent example combinations, further including a traveler within the chamber and coupled to the base assembly, wherein the traveler includes a plunger driver configured to selectively engage the plunger within the plunger cavity, and wherein the traveler is configured to axially move within the chamber through rotation of the base of the base assembly.

EC 10. The dosing dispenser of any of the preceding or subsequent example combinations, wherein the base assembly further includes a drive screw, wherein the base is coupled to the drive screw such that rotation of the base rotates the drive screw, and wherein the drive screw is threadably engaged with the traveler such that rotation of the drive screw axially moves the traveler.

EC 11. The dosing dispenser of any of the preceding or subsequent example combinations, wherein the traveler is movable between a disengaged position and an engaged position relative to the plunger, wherein in the disengaged position, the traveler is spaced apart from the plunger within the chamber, and wherein in the engaged position, the plunger driver abuts the plunger within the plunger cavity.

EC 12. The dosing dispenser of any of the preceding or subsequent example combinations, wherein the base assembly further includes: a base support including a mounting portion and a supporting portion, wherein the mounting portion is coupled to the second end of the housing, wherein the supporting portion defines a supporting portion cavity and at least one notch, and wherein the base support rotatably supports the base relative to the housing; and a cam including a body and at least one arm, wherein the cam is retained within the supporting portion cavity and rotatable relative to the base support, and wherein the cam is configured to provide auditory feedback upon engagement of the at least one arm with the at least one notch as the cam is rotated.

EC 13. The dosing dispenser of any of the preceding or subsequent example combinations, wherein a cross-sectional shape of the mounting portion of the base support is different from a cross-sectional shape of the supporting portion of the base support, and wherein a cross-sectional shape of the housing is substantially similar to a cross-sectional shape of the base.

EC 14. The dosing dispenser of any of the preceding or subsequent example combinations, wherein a cross-sectional shape of the plunger is substantially similar to a cross-sectional shape of the chamber such that the plunger forms a fluid tight seal with the housing within the chamber as the plunger is movably positioned within the chamber.

EC 15. A dosing dispenser including: a housing having a first end and a second end, the housing defining a chamber extending from the first end to the second end, the first end of the housing including a dispensing channel in fluid communication with the chamber; a plunger including a first end and a second end, the plunger positionable within the chamber with the first end proximate to the first end of the housing and the second end proximate to the second end of the housing, the second end of the plunger defining a plunger cavity, the plunger defining a filling portion of the chamber between the first end of the housing and the first end of the plunger; and a traveler including a plunger driver, the traveler configured to movably position the plunger within the chamber, the traveler movable between a disengaged position and an engaged position relative to the plunger, wherein in the disengaged position, the traveler is spaced apart from the plunger within the chamber, and wherein in the engaged position, the plunger driver abuts the plunger within the plunger cavity.

EC 16. The dosing dispenser of any of the preceding or subsequent example combinations, wherein in the engaged position, the traveler and plunger are movable within the chamber between a filled position and a dispensed position, wherein in the filled position, the first end of the plunger is spaced apart from the first end of the housing and volume of the filling portion of the chamber is at a maximum, and wherein in the dispensed position, the first end of the plunger abuts the first end of the housing and the volume of the filling portion of the chamber is at a minimum.

EC 17. The dosing dispenser of any of the preceding or subsequent example combinations, wherein the traveler includes a first end and a second end, wherein the plunger driver extends from the first end of the traveler, wherein the traveler includes at least one collar between the first end and the second end that is configured to resist rotation of the traveler as the traveler is movably positioned within the chamber.

EC 18. The dosing dispenser of any of the preceding or subsequent example combinations, wherein the traveler defines a traveler chamber extending from the first end to the second end, wherein at least a portion of the traveler chamber includes threading, and wherein the dosing dispenser further includes a drive screw threadably engaged with the threading of the traveler and configured to movably position the traveler within the chamber.

EC 19. The dosing dispenser of any of the preceding or subsequent example combinations, further including a base assembly coupled to the second end of the housing, the base assembly including a base and configured to movably position the traveler within the chamber through rotation of the base, wherein the base assembly further includes: a drive screw threadably engaged with the traveler and coupled to the base such that rotation of the base rotates the drive screw and axially moves the traveler within the chamber; a base support rotatably supporting the drive screw and the base, the base support including a mounting portion and a supporting portion, the supporting portion including at least one notch; a cam mounted on the drive screw and including at least one extension configured to engage the at least one notch as the cam is rotated through the drive screw.

EC 20. The dosing dispenser of any of the preceding or subsequent example combinations, wherein the drive screw includes a first end, a second end, and a support collar between the first end and the second end, wherein the drive screw includes external threads between the first end and the support collar configured to threadably engage the traveler, wherein the drive screw includes a key between the support collar and the second end, and wherein the base and cam each define a keyhole dimensioned to accommodate the key.

EC 21. A dosing dispenser comprising: a housing defining a chamber; a traveler within the chamber; and a plunger within the chamber, wherein the traveler is movable along an axis between an engaged position and a disengaged position relative to the plunger, and wherein the traveler is spaced apart from the plunger in the disengaged position.

EC 22. The dosing dispenser of any of the preceding or subsequent example combinations, wherein the plunger comprises a first end and a second end, wherein the second end of the plunger defines a plunger cavity, and wherein the plunger defines a filling portion of the chamber between the first end of the housing and the first end of the plunger.

EC. 23. The dosing dispenser of any of the preceding or subsequent example combinations, wherein the traveler is configured to abut and selectively position the plunger in the engaged position.

EC 24. The dosing dispenser of any of the preceding or subsequent example combinations, wherein the traveler comprises a first end and a second end, wherein the first end comprises a plunger driver configured to selectively engage the plunger within a plunger cavity of the plunger and movably position the plunger within the chamber.

EC 25. The dosing dispenser of any of the preceding or subsequent example combinations, further comprising a base assembly coupled to the housing, the base assembly comprising a base and configured to movably position the traveler within the chamber through rotation of the base.

EC 26. The dosing dispenser of any of the preceding or subsequent example combinations, wherein in the disengaged position, the traveler is spaced apart from the plunger, and wherein in the engaged position, a plunger driver of the traveler abuts the plunger within a plunger cavity of the plunger.

EC 27. The dosing dispenser of any of the preceding or subsequent example combinations, wherein the housing comprises a dispensing channel, wherein the plunger comprises a crown, wherein the plunger defines a filling portion of the chamber between the dispensing channel and the plunger, and wherein at least a portion of the crown is positionable within the dispensing channel of the housing when a volume of the filling portion of the chamber is at a minimum.

EC 28. The dosing dispenser of any of the preceding or subsequent example combinations, wherein the housing further comprises an intermediate chamber between the chamber and the dispensing channel, and wherein at least a portion of the crown is positionable within the intermediate chamber when the volume of the filling portion of the chamber is at the minimum.

EC 29. A dosing dispenser comprising: a housing defining a chamber; a traveler positionable within the chamber; and a plunger positionable within the chamber, wherein the traveler is independently positionable along an axis relative to the plunger in at least one direction within the chamber.

EC 30. The dosing dispenser of any of the preceding or subsequent example combinations, wherein the chamber comprises a first end and a second end, wherein the housing further comprises a dispensing channel in fluid communication with the chamber at the first end, and wherein the at least one direction is away from the first end.

EC 31. The dosing dispenser of any of the preceding or subsequent example combinations, wherein the housing further comprises a dispensing channel in fluid communication with the chamber, and wherein the at least one direction is away from the dispensing channel.

EC 32. The dosing dispenser of any of the preceding or subsequent example combinations, wherein the traveler is configured to abut and selectively position the plunger in the a direction opposite the at least one direction.

EC 33. The dosing dispenser of any of the preceding or subsequent example combinations, further comprising a base assembly configured to movably position the traveler within the chamber.

EC 34. The dosing dispenser of any of the preceding or subsequent example combinations, wherein the base assembly comprises: a base; a drive screw threadably engaged with the traveler and coupled to the base such that rotation of the base rotates the drive screw and axially moves the traveler within the chamber; a base support rotatably supporting the drive screw and the base, the base support comprising a mounting portion and a supporting portion, the supporting portion comprising at least one notch; and a cam mounted on the drive screw and comprising at least one extension configured to engage the at least one notch as the cam is rotated through the drive screw.

EC 35. The dosing dispenser of any of the preceding or subsequent example combinations, wherein a cross-sectional shape of the plunger is substantially similar to a cross-sectional shape of the chamber such that the plunger forms a fluid tight seal with the housing within the chamber as the plunger is movably positioned within the chamber.

EC 36. A method of dispensing a flowable composition with a dosing dispenser, the method comprising: positioning a plunger within a chamber defined by a housing of the dosing dispenser; positioning a traveler within the chamber such that the traveler is spaced apart from the plunger; and loading the flowable composition within the chamber.

EC 37. The method of any of the preceding or subsequent example combinations, wherein the housing comprises a first end and a second end, wherein the first end comprises a dispensing channel in fluid communication with the chamber, wherein positioning the plunger within the chamber comprises abutting the plunger against the first end of the housing within the chamber, and wherein loading the flowable composition comprises loading the flowable composition through the dispensing channel.

EC 38. The method of any of the preceding or subsequent example combinations, wherein the plunger comprises a crown, and wherein positioning the plunger within the chamber comprises positioning at least a portion of the crown within the dispensing channel.

EC 39. The method of any of the preceding or subsequent example combinations, wherein loading the flowable composition comprises loading a predetermined volume of the flowable composition within the chamber between a dispensing end of the housing and a first end of the plunger facing the dispensing end, and wherein the method further comprises: advancing the traveler within the chamber such that the traveler abuts a second end of the plunger opposite the first end after the predetermined volume is loaded; and dispensing the flowable composition from the dispensing end of the housing by advancing the traveler towards the dispensing end.

EC 40. The method of any of the preceding or subsequent example combinations, further comprising: positioning the traveler within the chamber such that the traveler abuts the plunger after the flowable composition is loaded; and advancing the traveler within the chamber such that the traveler movably positions the plunger within the chamber and dispenses the flowable composition from the housing.

EC 42. A method of dispensing a flowable composition with a dosing dispenser, the method comprising: positioning a plunger within a chamber defined by a housing of the dosing dispenser; positioning a traveler within the chamber such that the traveler is spaced apart from the plunger; and loading the flowable composition within the chamber, wherein loading the flowable composition within the chamber abuts the flowable composition against the plunger and moves the plunger within the chamber independently from the traveler.

EC 43. The method of any of the preceding or subsequent example combinations, wherein loading the flowable composition within the chamber abuts the flowable composition against the plunger such that no air gaps are formed between the plunger and the flowable composition.

The above-described aspects are merely possible examples of implementations, merely set forth for a clear understanding of the principles of the present disclosure. In some of the figures, various components are illustrated as transparent (represented by dashed lines) to show additional features of the dosing dispenser. It will be appreciated that in other examples, the components need not be transparent and may be opaque and/or have any other colors or shading. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims which follow, they are used only in a generic and descriptive sense, and not for the purposes of limiting the described invention, nor the claims which follow.

That which is claimed is:

1. A dosing dispenser comprising:

a housing defining a chamber;

a traveler within the chamber;

a driver at least partially within the chamber and engaged with the traveler such that rotation of the driver movably positions the traveler within the chamber; and a plunger within the chamber, wherein the traveler is movable along an axis between an engaged position and a disengaged position relative to the plunger within the chamber and when the dosing dispenser is assembled, and wherein the traveler is spaced apart from the plunger in the disengaged position within the chamber and when the dosing dispenser is assembled.

2. The dosing dispenser of claim 1, wherein the plunger comprises a first end and a second end, wherein the housing comprises a first end and a second end, wherein the second end of the plunger defines a plunger cavity, and wherein the plunger defines a filling portion of the chamber between the first end of the housing and the first end of the plunger.

3. The dosing dispenser of claim 1, wherein the traveler is configured to abut and selectively position the plunger in the engaged position.

4. The dosing dispenser of claim 3, wherein the traveler comprises a first end and a second end, wherein the first end comprises a plunger driver configured to selectively engage the plunger within a plunger cavity of the plunger and movably position the plunger within the chamber.

5. The dosing dispenser of claim 1, further comprising a base assembly coupled to the housing, the base assembly comprising a base and configured to movably position the traveler within the chamber through rotation of the base.

6. The dosing dispenser of claim 1, wherein in the disengaged position, the traveler is spaced apart from the plunger, and wherein in the engaged position, a plunger driver of the traveler abuts the plunger within a plunger cavity of the plunger.

7. The dosing dispenser of claim 1, wherein the housing comprises a dispensing channel, wherein the plunger comprises a crown, wherein the plunger defines a filling portion of the chamber between the dispensing channel and the plunger, and wherein at least a portion of the crown is positionable within the dispensing channel of the housing when a volume of the filling portion of the chamber is at a minimum.

8. The dosing dispenser of claim 7, wherein the housing further comprises an intermediate chamber between the chamber and the dispensing channel, and wherein at least a portion of the crown is positionable within the intermediate chamber when the volume of the filling portion of the chamber is at the minimum.

9. A dosing dispenser comprising:

a housing defining a chamber and comprising a first end and a second end, wherein the first end comprises a dispensing aperture;

a traveler movable within the chamber, wherein the traveler comprises a first end and a second end opposite from the first end, and wherein the first end and the second end are retained within the chamber such that the traveler is retained within the chamber when assembled; and a plunger movable within the chamber, wherein the traveler is configured to selectively position the plunger along an axis in at least one direction within the chamber.

10. The dosing dispenser of claim 9, wherein the housing further comprises a dispensing channel in fluid communication with the chamber at the first end.

11. The dosing dispenser of claim 9, wherein the housing further comprises a dispensing channel in fluid communication with the chamber, and wherein the at least one direction is towards the dispensing channel.

12. The dosing dispenser of claim 9, wherein the traveler is configured to move independently from the plunger in a direction opposite from the at least one direction.

13. The dosing dispenser of claim 9, further comprising a base assembly configured to movably position the traveler within the chamber.

14. The dosing dispenser of claim 13, wherein the base assembly comprises:

a base;

a drive screw threadably engaged with the traveler and coupled to the base such that rotation of the base rotates the drive screw and axially moves the traveler within the chamber;

a base support rotatably supporting the drive screw and the base, the base support comprising a mounting portion and a supporting portion, the supporting portion comprising at least one notch; and a cam mounted on the drive screw and comprising at least one extension configured to engage the at least one notch as the cam is rotated by the drive screw.

15. The dosing dispenser of claim 9, wherein a cross-sectional shape of the plunger is substantially similar to a cross-sectional shape of the chamber such that the plunger forms a fluid tight seal with the housing within the chamber as the plunger is movably positioned within the chamber.

16. A dosing dispenser comprising:

a housing defining a chamber;

a traveler comprising a first end and a second end opposite from the first end, wherein the traveler is retained within the chamber when the dosing dispenser is assembled such that the first end and the second end are within the chamber;

a driver at least within the chamber and engaged with the traveler such that rotation of the driver movably positions the traveler within the chamber; and a plunger within the chamber and engaged with the traveler such that movement of the traveler movably positions the plunger along an axis in at least one direction within the chamber when the dosing dispenser is assembled.

17. The dosing dispenser of claim 16, wherein the traveler is movable along the axis between an engaged position and a disengaged position relative to the plunger within the chamber and when the dosing dispenser is assembled, and wherein the traveler is spaced apart from the plunger in the disengaged position within the chamber and when the dosing dispenser is assembled.

18. The dosing dispenser of claim 16, wherein the traveler is hollow and comprises a chamber extending from the first end to the second end of the traveler.

19. The dosing dispenser of claim 16, wherein the traveler comprises threading such that the traveler is threadably engaged with the driver within the chamber.

20. The dosing dispenser of claim 16, wherein the plunger comprises a first end and a second end, wherein the first end of the plunger is proximate to a first end of the housing relative to the second end of the plunger, wherein the second end of the plunger defines a plunger cavity, and wherein the first end of the traveler is configured to engage the plunger within the plunger cavity.

* * * * *